US010734746B2

(12) United States Patent
Ogasawara et al.

(10) Patent No.: US 10,734,746 B2
(45) Date of Patent: Aug. 4, 2020

(54) TERMINAL STRUCTURE, PORTABLE TERMINAL AND MANUFACTURING METHOD OF TERMINAL SECTION

(71) Applicant: CASIO COMPUTER CO., LTD., Shibuya-ku, Tokyo (JP)

(72) Inventors: Satoshi Ogasawara, Akishima (JP); Takahiro Nozaki, Akiruno (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 44 days.

(21) Appl. No.: 16/043,873

(22) Filed: Jul. 24, 2018

(65) Prior Publication Data

US 2019/0036262 A1 Jan. 31, 2019

(30) Foreign Application Priority Data

Jul. 28, 2017 (JP) ..... 2017-147099
Jul. 28, 2017 (JP) ..... 2017-147102
Aug. 8, 2017 (JP) ..... 2017-153531
Jul. 9, 2018 (JP) ..... 2018-129976

(51) Int. Cl.
*H01R 13/24* (2006.01)
*H01R 13/405* (2006.01)
*H01R 43/24* (2006.01)

(52) U.S. Cl.
CPC ..... *H01R 13/2478* (2013.01); *H01R 13/2407* (2013.01); *H01R 13/405* (2013.01); *H01R 43/24* (2013.01)

(58) Field of Classification Search
CPC ..... H01R 13/2478; H01R 13/2407; H01R 13/405; H01R 43/24
USPC ..... 439/700, 246, 289, 824
See application file for complete search history.

(56) References Cited

U.S. PATENT DOCUMENTS 3,192,498 A * 6/1965 Ruehlemann ..... H01R 13/111 439/223
6,048,228 A * 4/2000 Aso ..... H01R 13/2428 439/660
6,517,359 B1 * 2/2003 Felps ..... H01R 13/2421 439/246
8,172,591 B2 * 5/2012 Wertz ..... H01R 12/718 439/246

(Continued)

FOREIGN PATENT DOCUMENTS

JP H0580138 U 10/1993
JP H08223261 A 8/1996

(Continued)

OTHER PUBLICATIONS

Japanese Office Action dated Aug. 1, 2019 (and English translation thereof) issued in counterpart Japanese Application No. 2018-129976.

(Continued)

*Primary Examiner* — Travis S Chambers
(74) *Attorney, Agent, or Firm* — Holtz, Holtz & Volek PC

(57) ABSTRACT

A terminal structure in which a groove extending in a predetermined direction is provided in a contact target section with which a tip portion of a contact pin comes in contact, and the tip portion slides on an edge of the groove along the groove by a pressing force occurred when the tip portion is butted against the contact target section so as to come in contact with the contact target section.

16 Claims, 29 Drawing Sheets

(56) References Cited

U.S. PATENT DOCUMENTS

2014/0357138 A1* 12/2014 Nakamura ..... H01R 13/113
439/884

FOREIGN PATENT DOCUMENTS

| | | | |
|---|---|---|---|
| JP | 2000208192 | A | 7/2000 |
| JP | 2005005157 | A | 1/2005 |
| JP | 2012248373 | A | 12/2012 |

OTHER PUBLICATIONS

Chinese Office Action (and English language translation thereof) dated Oct. 11, 2019 issued in counterpart Chinese Application No. 201810845247.1.
Japanese Office Action dated Sep. 25, 2019 (and English translation thereof) issued in Japanese Application No. 2017-147102.

* cited by examiner

TERMINAL STRUCTURE, PORTABLE TERMINAL AND MANUFACTURING METHOD OF TERMINAL SECTION

CROSS-REFERENCE TO RELATED APPLICATION

This application is based upon and claims the benefit of priority from the prior Japanese Patent Applications No. 2017-147102, filed Jul. 28, 2017, No. 2017-147099, filed Jul. 28, 2017, No. 2017-153531, filed Aug. 8, 2017, and No. 2018-129976, filed Jul. 9, 2018, the entire contents of which are incorporated herein by reference.

BACKGROUND OF THE INVENTION

1. Field of the Invention

The present invention relates to a terminal structure used for an electronic device such as a portable terminal and a cellular phone, a portable terminal including same, and a manufacturing method of a terminal section.

2. Description of the Related Art

For example, in a cradle for charging a portable terminal, a structure has been known in which a fitting recessed section into which an end portion of a portable terminal is inserted is provided on a base, a movable contact terminal is provided inside the base so as to be advanced into and retracted from the fitting recessed section and, when the end portion of the portable terminal is mounted in the fitting recessed section of the base, the movable contact terminal of the base slides with it being in contact with a contact target section of a terminal provided in the end portion of the portable terminal, thereby electrically connecting the terminal of the portable terminal and the movable contact terminal of the base, as described in Japanese Patent Application Laid-Open (Kokai) Publication No. 2012-248373.

The movable contact terminal of this type of cradle is provided with a contact protruding section that protrudes so as to be advanced into and retracted from a fitting recessed section of a base, an arm section provided at an inner end portion of the contact protruding section located inside the base, a support section that supports one end portion of the arm section, and a spring section that resiliently forces the contact protruding section toward the inside of the fitting recessed section with the support section as a fulcrum.

As a result, this cradle is structured such that, when the end portion of the portable terminal is mounted in the fitting recessed section of the base, the contact target section of the terminal of the portable terminal comes in contact with the contact protruding section of the movable contact terminal and, when the end portion of the terminal is pushed into the fitting recessed section of the base and the contact target section of the terminal of the portable terminal presses the contact protruding section of the movable contact terminal, the arm section rotates around the support section of the movable contact terminal, and the contact protruding section moves in accordance with the rotation of this arm section, whereby the contact protruding section slides with it being in elastic contact with the contact target section of the terminal of the portable terminal.

However, in such a cradle, since the contact protruding section of the movable contact terminal slides with it being in contact with the contact target section of the terminal of the portable terminal, even if contamination of the contact target section of the terminal of the portable terminal can be removed, the contamination of the contact target section of the terminal of the portable terminal cannot be completely removed at an end portion where sliding of the contact protruding section stops. Furthermore, since the contact protruding section comes in contact with the contact target section of the terminal of the portable terminal with one-point contact or line contact, conductivity between the contact target section of the terminal of the portable terminal and the contact protruding section of the movable contact terminal tends to be unstable and therefore there is a problem of lacking reliability of connection performance.

SUMMARY OF THE INVENTION

In accordance with one aspect of the present invention, there is provided a terminal structure wherein a groove extending in a predetermined direction is provided in a contact target section with which a tip portion of a contact pin comes in contact, and wherein the tip portion slides on an edge of the groove along the groove by a pressing force occurred when the tip portion is butted against the contact target section so as to come in contact with the contact target section.

In accordance with another aspect of the present invention, there is provided a terminal structure wherein a protruding section extending in a predetermined direction is provided in a contact target section with which a tip portion of a contact pin comes in contact, and wherein the tip portion slides on one side of the protruding section along the protruding section by a pressing force occurred when the tip portion is butted against the contact target section so as to come in contact with the contact target section.

In accordance with another aspect of the present invention, there is provided a manufacturing method of a terminal section, comprising: a first step of fabricating a terminal in which a groove extending in a predetermined direction is provided in a first surface of a contact target section with which a tip portion of a contact pin comes in contact; a second step of superimposing a second mold on a first mold holding the terminal and, in a state where the second mold is in contact with the first surface of the contact target section, pressing and fixing a second surface located on back of the first surface of the contact target section to the second mold by a pressing section; and a third step of injecting a resin into a space section formed in the first mold and the second mold so as to mold the terminal excluding the first surface of the contact target section.

In accordance with another aspect of the present invention, there is provided a manufacturing method of a terminal section, comprising: a first step of fabricating a terminal in which a protruding section extending in a predetermined direction is provided in a first surface of a contact target section with which a tip portion of a contact pin comes in contact; a second step of superimposing a second mold on a first mold holding the terminal and, in a state where the second mold is in contact with the first surface of the contact target section excluding the protruding section, pressing and fixing a second surface located on back of the first surface of the contact target section to the second mold by a pressing section; and a third step of injecting a resin into a space section formed in the first mold and the second mold so as to mold the terminal excluding the first surface of the contact target section and the protruding section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

A first embodiment in which the present invention is applied to a portable terminal will hereinafter be described with reference to FIGS. 1 to 11.

Figure 1:
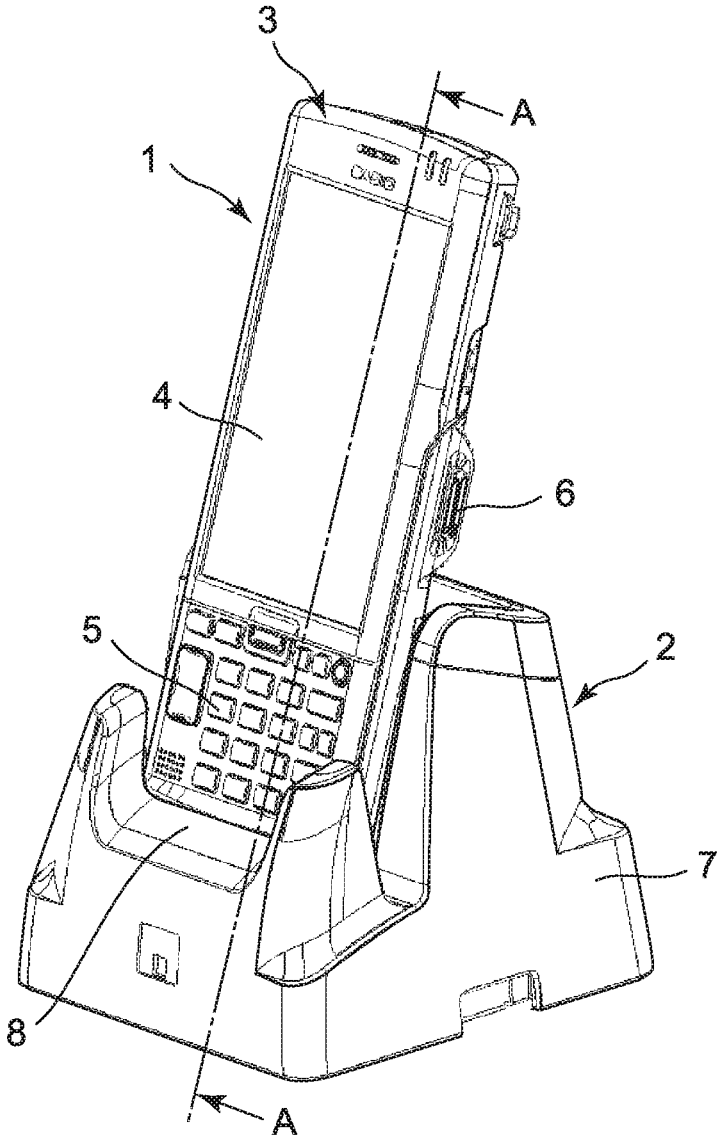
FIG. 1 is a perspective view showing a state where a portable terminal according to a first embodiment is mounted on a cradle.

As shown in FIG. 1, a portable terminal 1 is structured to be detachably attached to a cradle 2 by insertion. The portable terminal 1 is provided with a device case 3. The device case 3 is formed in a substantially rectangular box shape elongated in a longitudinal direction (vertical direction in FIG. 1).

As shown in FIG. 1, a display section 4 that displays information and an input section 5 that inputs information are provided in a front surface of the device case 3, and a side switch 6 is provided is provided in a side surface of the device case 3. The display section 4 is a flat type display panel such as a liquid crystal display panel or an EL (electro luminescence) display panel and is provided in a substantially half area on an upper side of the device case 3 to electrooptically display information.

As shown in FIG. 1, the input section 5 is provided with various keys such as a numeric keypad, a cursor key, an enter key, and a function key, and is structured to enable input of information by a key operation provided in a substantially half area on a lower side of the device case 3. The side switch 6 is a trigger key and is structured to drive an optical reading section (not shown) provided on an upper side portion of the device case 3 to cause the optical reading section to read a bar code of an article.

As shown in FIG. 1, the cradle 2 to which the portable terminal 1 is mounted charges the portable terminal 1 and exchanges data with the portable terminal 1. This cradle 2 is provided with a base 7. In this base 7, a fitting recessed section 8 to which the device case 3 of the portable terminal 1 is detachably attached by insertion obliquely from above is provided.

Figure 2A:
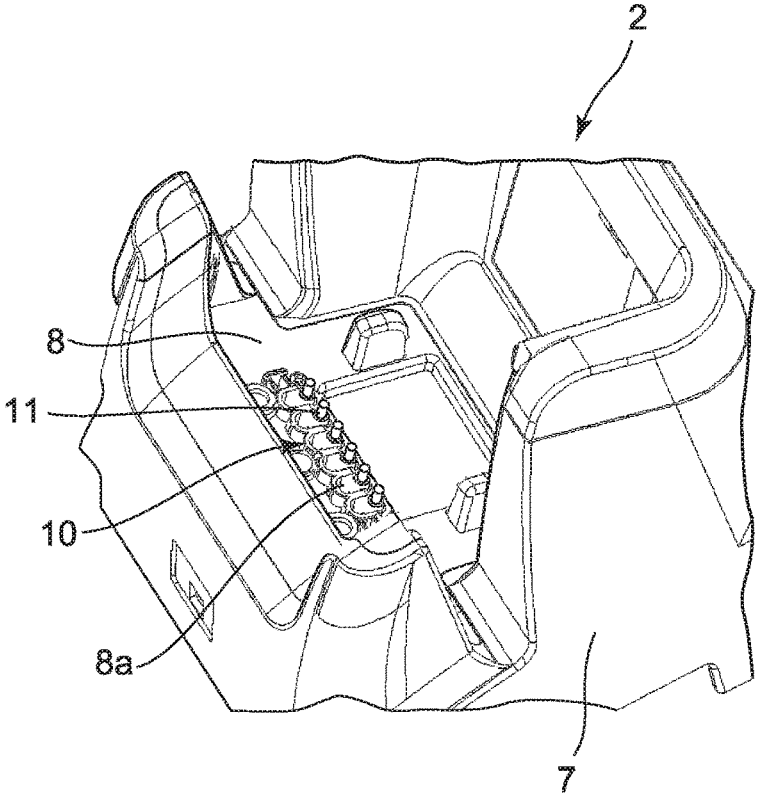
FIG. 2A is an enlarged perspective view of a main part of a fitting recessed section of the cradle on which the portable terminal shown in FIG. 1 is mounted.
Figure 2B:
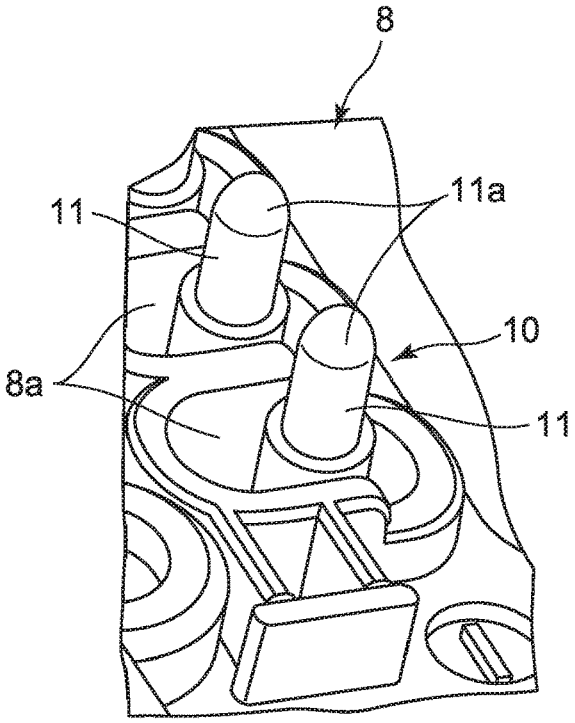
FIG. 2B is a perspective view in which the main part of FIG. 2A is further enlarged.
Figure 3:
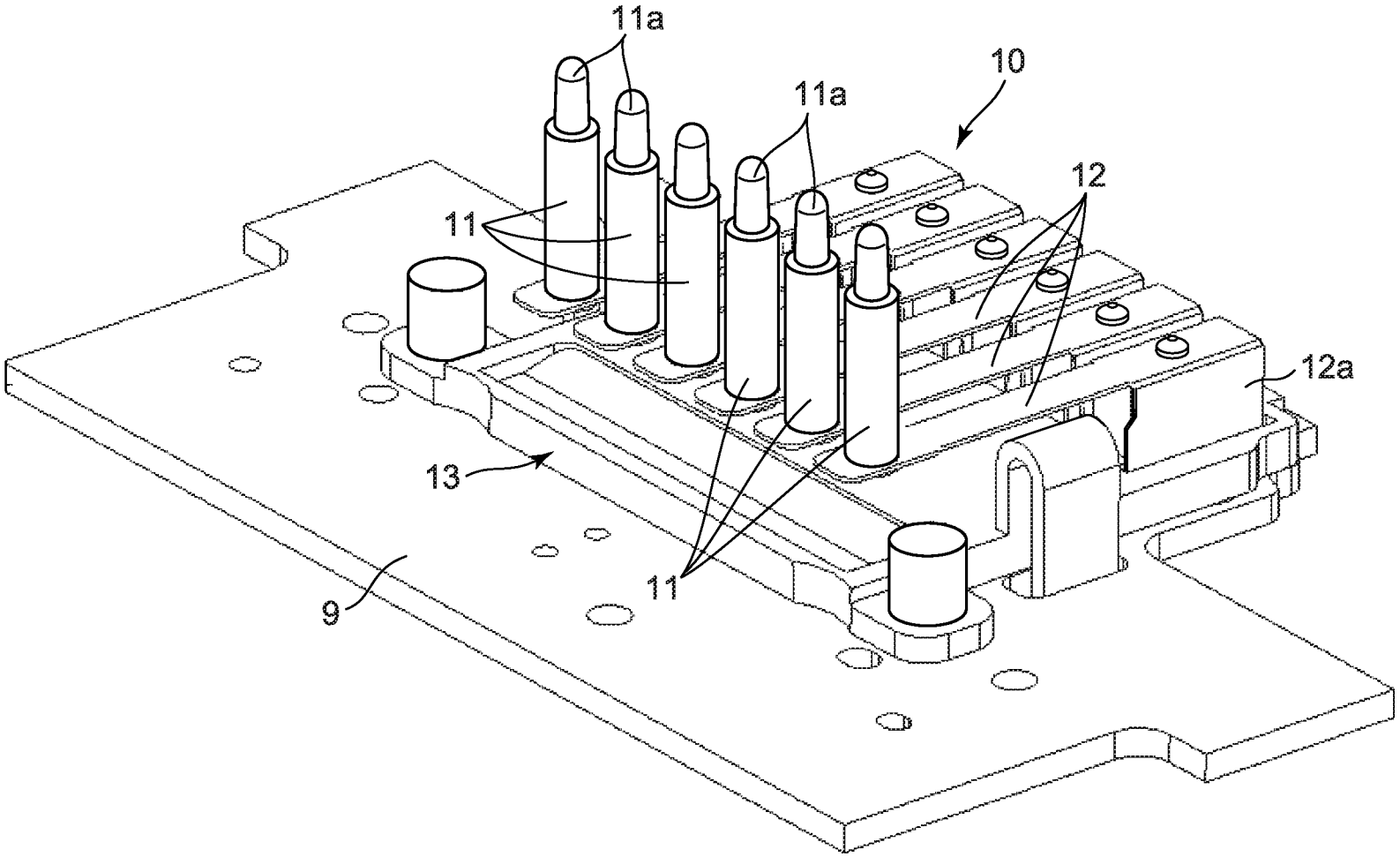
FIG. 3 is an enlarged perspective view of a main part, showing a connection section provided in the cradle shown in FIGS. 2A and 2B.
Figure 4:
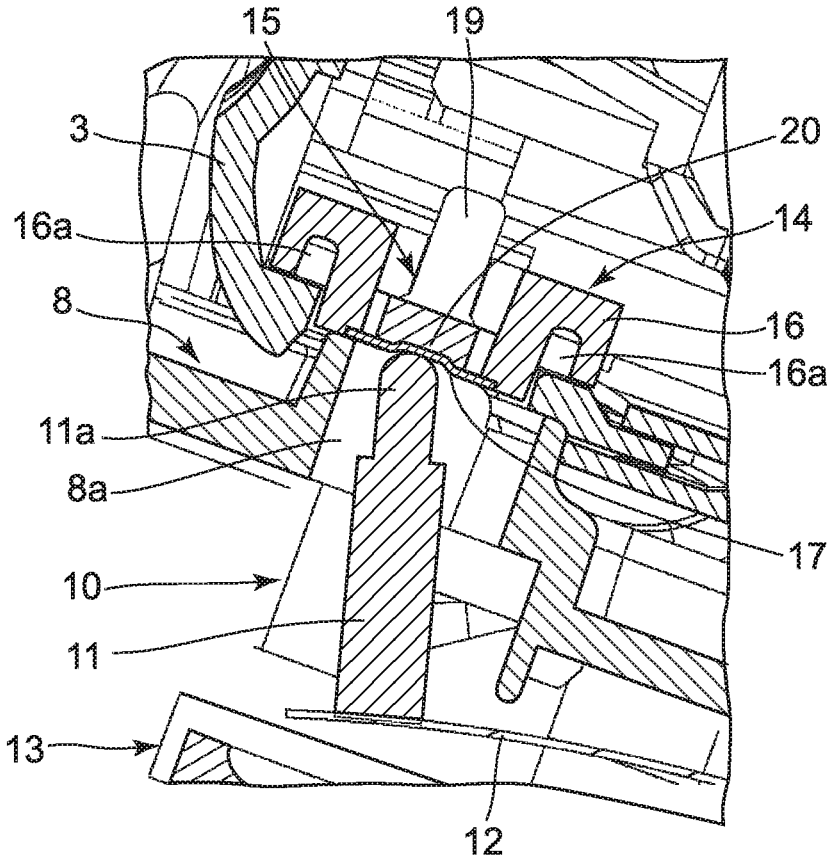
FIG. 4 is an enlarged cross-sectional view showing the main part of the portable terminal and the cradle taken along line A-A shown in FIG. 1.
Figure 5:
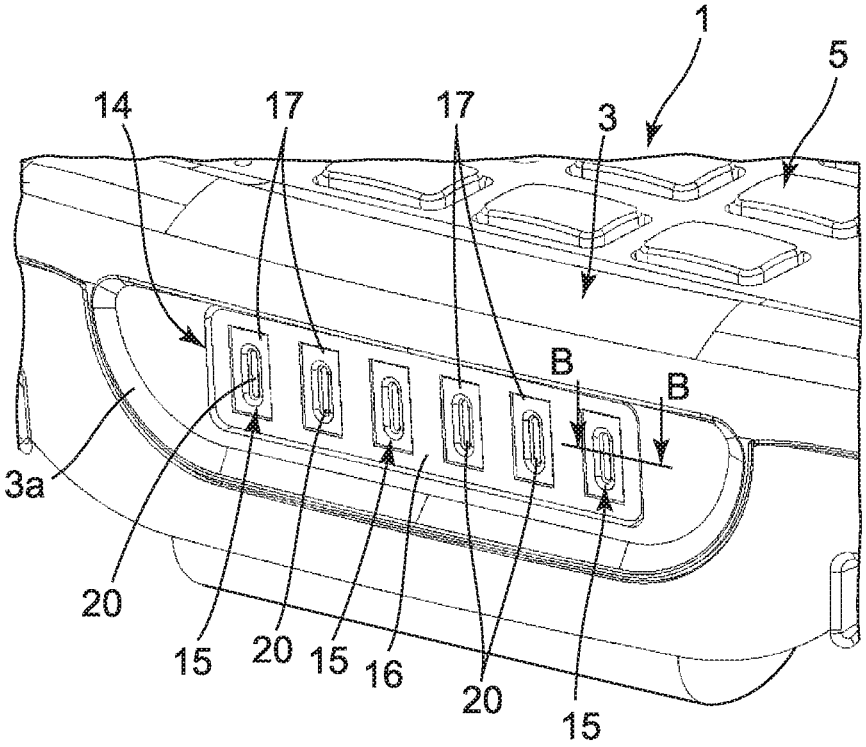
FIG. 5 is an enlarged perspective view of a main part, showing a lower end side of the portable terminal shown in FIG. 1.

As shown in FIG. 2A, FIG. 2B and FIG. 3, a connection section 10 for electrically connecting the cradle 2 to the portable terminal 1 is provided in a bottom portion of the fitting recessed section 8. This connection section 10 is provided with a plurality of contact pins 11, a plurality of leaf springs 12 that hold these plurality of contact pins 11, a connection base 13 in which the plurality of leaf springs 12 are arranged, and a connection substrate 9 in which the connection base 13 is arranged. The connection substrate 9 and the connection base 13 are arranged inside the base 7.

As shown in FIG. 3, one end of each of the plurality of leaf springs 12 is respectively attached to a plurality of support bases 12*a* which are arranged at regular intervals on the connection base 13, and is structured such that an other end side is flexed and deformed with the support bases 12*a* as a support point in a vertical direction. Each of the plurality of contact pins 11 is erected and provided on each of the other ends of the plurality of leaf springs 12 located opposite to the support base 12*a* in the plurality of leaf springs 12.

As shown in FIG. 2A, FIG. 2B and FIG. 3, the plurality of contact pins 11 are each formed in a columnar shape, and each tip portion 11*a* located at the upper end thereof is formed in a hemispherical shape or a curved shape. The plurality of contact pins 11 are structured such that their each tip portion 11*a* protrudes to such an extent that they can advance into and retreat from the fitting recessed section 8 through each opening section 8*a* provided in the bottom portion of in the fitting recessed section 8 of the base 7.

As a result, the connection section 10 is structured such that, when the device case 3 of the portable terminal 1 is attached by insertion to the fitting recessed section 8 of the cradle 2, each terminal 15 of a terminal section 14 provided at an end portion on a bottom edge side of the portable terminal 1 is elastically brought into contact with each tip portion 11*a* of the plurality of contact pins 11, respectively, as shown in FIG. 2A to FIG. 4.

More specifically, the connection section 10 is structured such that, when the device case 3 of the portable terminal 1 is pushed into the fitting recessed section 8 of the cradle 2 and each terminal 15 of the terminal section 14 of the portable terminal 1 presses each tip portion 11*a* of the plurality of contact pins 11, each of the leaf springs 12 are respectively flexed and deformed, and therefore each tip portion 11*a* of the plurality of contact pins 11 slides in a predetermined direction in accordance with the flexural deformation of each of the leaf springs 12 with it being in elastic contact with each terminal 15 of the portable terminal 1, as shown in FIG. 2A to FIG. 4.

As shown in FIGS. 5 to 8C, the terminal section 14 of the portable terminal 1 is provided with the plurality of terminals 15 arranged at regular intervals and a substantially rectangular terminal holder (resin holder) 16 elongated in an arrangement direction (left and right in FIG. 8A) of these pluralities of terminals 15. This terminal section 14 is embedded in the terminal holder 16 made of synthetic resin in a state where the plurality of terminals 15 are arranged along a longitudinal direction of the terminal holder 16. In this state, the terminal section 14 is attached to a lower end portion in the device case 3, and is structured to be exposed to outside from an opening section 3*a* provided at the lower end portion of the device case 3.

More specifically, the terminal section 14 is attached to the lower end portion in the device case 3 in a state where an edge portion of the opening section 3*a* provided at the lower end portion of the device case 3 is engaged with a mounting groove 16*a* provided around the terminal holder 16 made of synthetic resin, as shown in FIGS. 5 to 8C. As a result, the terminal section 14 is structured such that each contact target section 17 of the plurality of terminals 15 are exposed to outside from the opening section 3*a* of the device case 3.

Figure 6A:
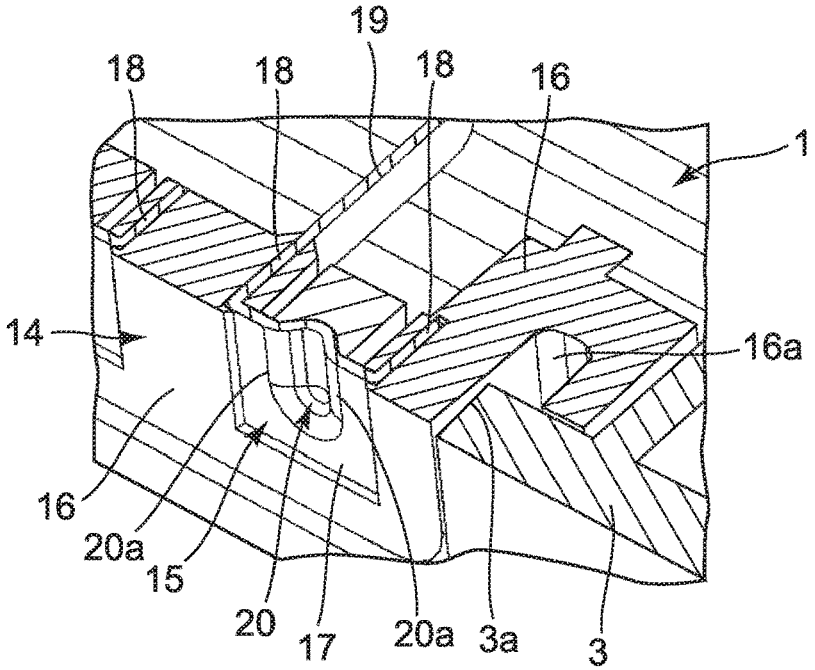
FIG. 6A is an enlarged perspective view showing a terminal section of the portable terminal shown in FIG. 5 with the main part being cut along line B-B.
Figure 6B:
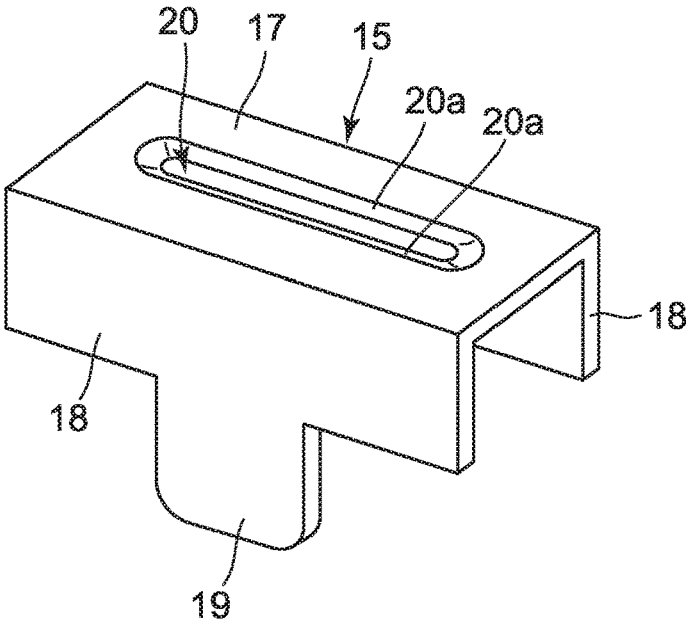
FIG. 6B is an enlarged perspective view showing a terminal of the terminal section of the portable terminal shown in FIG. 5.

As shown in FIGS. 6A and 6B, these pluralities of terminals 15 are each formed of a metal plate, and a surface of the metal plate is subjected to conductive plating such as gold or silver. Each of the plurality of terminals 15 is provided with the contact target section 17 having a vertically long quadrangular shape, a pair of reinforcing sections 18 that are provided being bent on both sides of this contact target section 17, and a connection piece 19 provided in one of the pairs of these reinforcing sections 18.

More specifically, the plurality of terminals 15 are each provided in the terminal holder 16 and arranged along the longitudinal direction thereof, in a state where the contact target section 17 is arranged and exposed on a surface of the terminal holder 16, the pair of reinforcing sections 18 are embedded in the terminal holder 16, and the connection piece 19 protrudes to a back surface side of the terminal holder 16, as shown in FIGS. 5 to 8C.

Consequently, each of the plurality of terminals 15 is firmly attached to the terminal holder 16 by the pair of reinforcing sections 18 being embedded in the terminal holder 16. In addition, the plurality of terminals 15 are structured to be electrically connectable to a circuit board (not shown) inside the portable terminal 1 by the connection piece 19 being protruding to the back surface side of the terminal holder 16, as shown in FIGS. 5 to 8C.

Moreover, the contact target section 17 is a portion where a front surface that is a first surface thereof is brought into contact with the tip portion 11*a* of the contact pin 11 of the connection section 10 and where the tip portion 11*a* slides, and is formed in a quadrangular flat plate shape, as shown in FIGS. 6A and 6B. In the contact target section 17, a groove section 20 extending in a longitudinal direction in which the tip portion 11*a* of the contact pin 11 slides is provided so as to be opened on a front surface side thereof.

More specifically, the groove section 20 has an inverted mountain shape protruding from a front surface of the contact target section 17 toward a back surface thereof and is provided extending on a longitudinal center line on the front surface of the contact target section 17, as shown in FIGS. 6A and 6B. In this groove section 20, a length in a longitudinal direction that is an extending direction thereof is set to be equal to or slightly longer than a length at which the tip portion 11*a* of the contact pin 11 slides.

Figure 7:
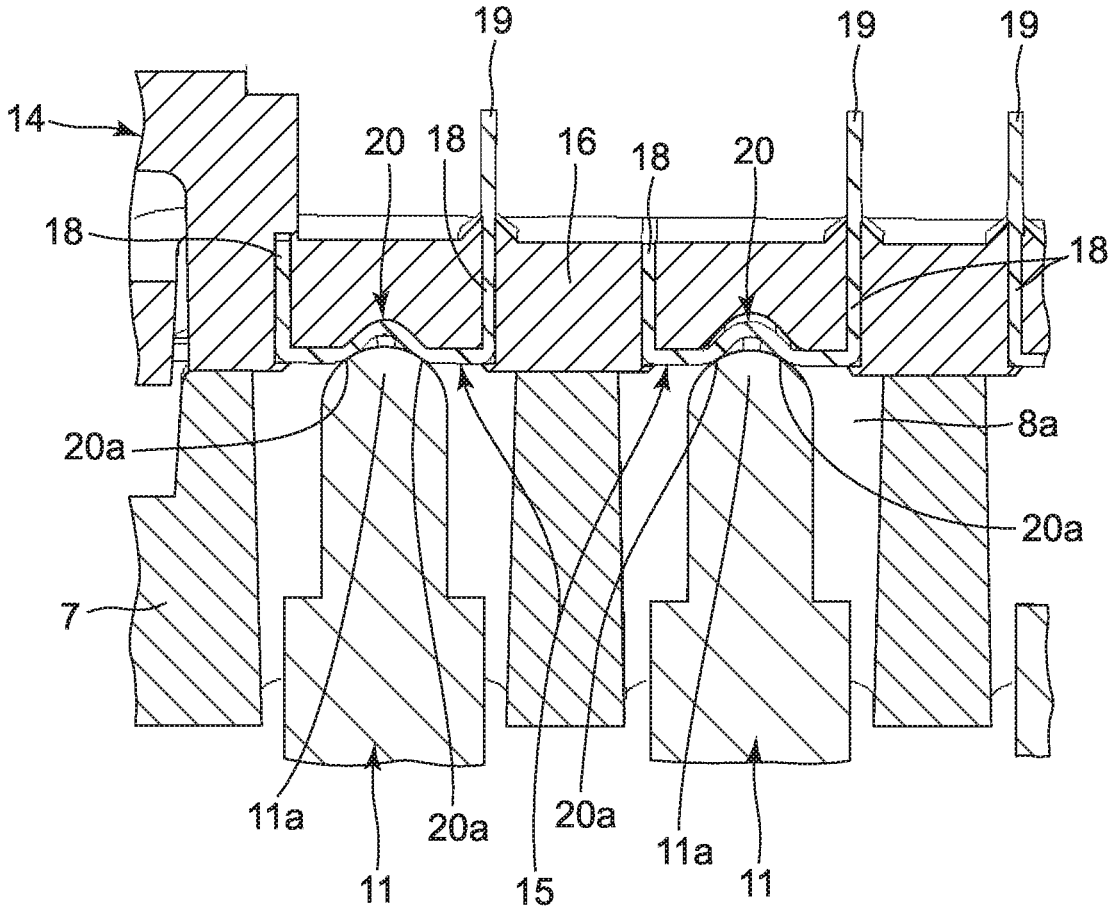
FIG. 7 is an enlarged cross-sectional view of the main part, showing a state where a contact pin is pressed against the terminal shown in FIGS. 6A and 6B.
Figure 8A:
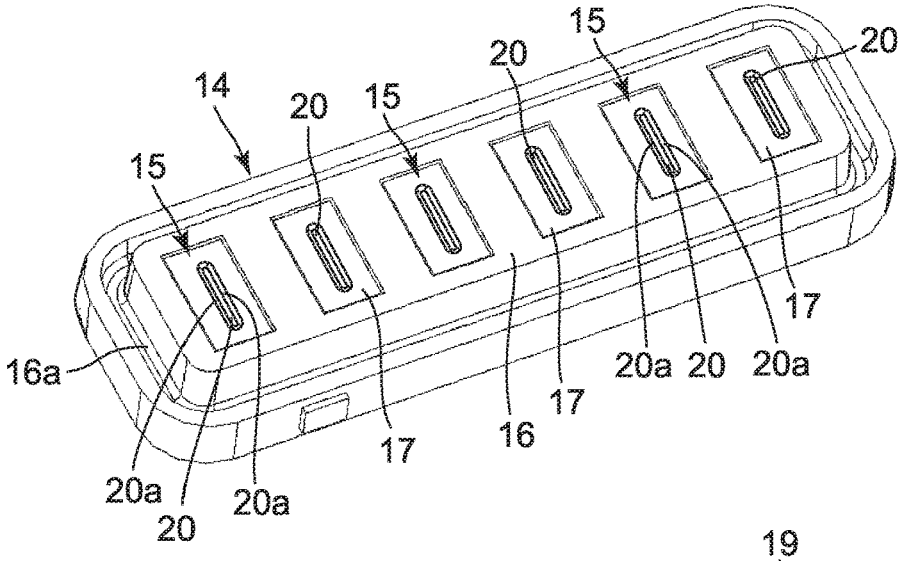
FIG. 8A is an enlarged perspective view of a terminal section of the portable terminal shown in FIG. 5 when viewed from a front surface side.
Figure 8B:
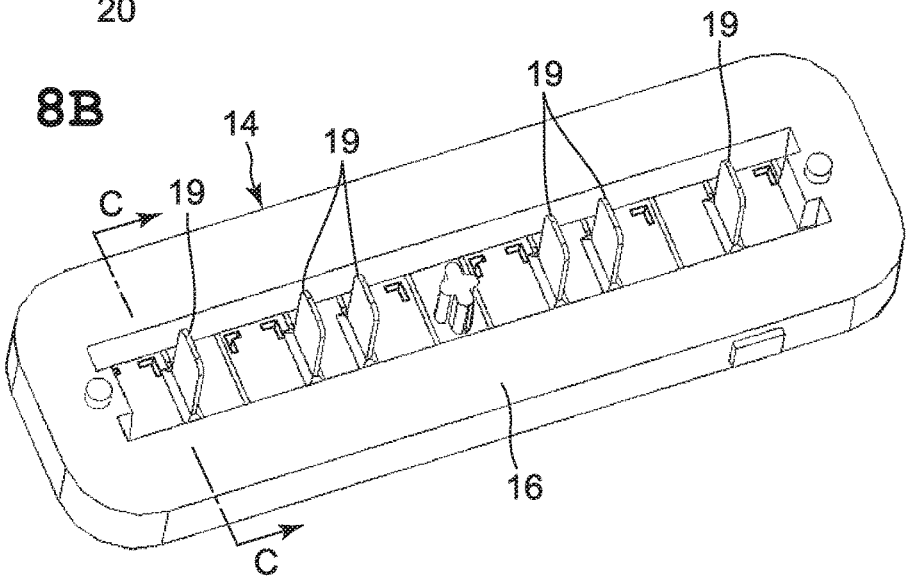
FIG. 8B is an enlarged perspective view of the terminal section of the portable terminal shown in FIG. 5 when viewed from a back surface side.
Figure 8C:
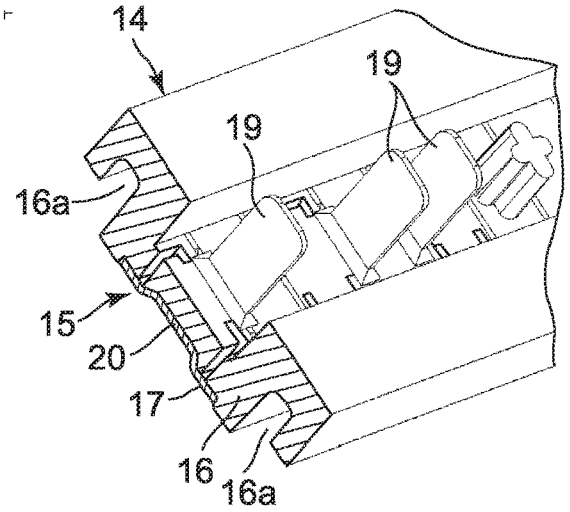
FIG. 8C is an enlarged perspective view of the main part taken along line C-C in FIG. 8B.

In addition, in this groove section 20, a groove width in a lateral direction (width direction) orthogonal to the longitudinal direction that is the extending direction thereof is formed smaller than a diameter of the tip portion 11*a* of the contact pin 11, as shown in FIGS. 6A, 6B and 7. As a result, the groove section 20 is formed such that the tip portion 11*a* of the contact pin 11 elastically comes in contact with edges 20*a* located on both sides in a groove width direction of the groove section 20 and, in this state, the tip portion 11*a* slides along the extending direction of the groove section 20.

More specifically, the groove section 20 is structured such that, when butted against the contact target section 17, the tip portion 11*a* of the contact pin 11 elastically comes in contact with the edges 20*a* located on both sides in the groove width direction of the groove section 20, thereby controlling a position of the tip portion 11*a* in the groove width direction of the groove section 20, as shown in FIGS. 6A, 6B and 7. As a result, the groove section 20 is structured to slide the tip portion 11*a* of the contact pin 11 along the extending direction of the groove section 20.

For this reason, the tip portion 11*a* of the contact pin 11 is structured to make two-point contact with the contact target section 17 at two points of the edges 20*a* on both sides in the groove width direction of the groove section 20, as shown in FIG. 7. That is, the tip portion 11*a* of the contact pin 11 is structured to, when butted against the edges 20*a* on both sides in the groove width direction of the groove section 20 of the contact target section 17, come in contact with the two points of the edges 20*a* on both sides of the groove section 20 (make two-point contact), and slide along the groove section 20 in this state.

Next, a procedure for manufacturing the terminal section 14 of the portable terminal 1 will be described with reference to FIGS. 9 to 11.

Figure 9:
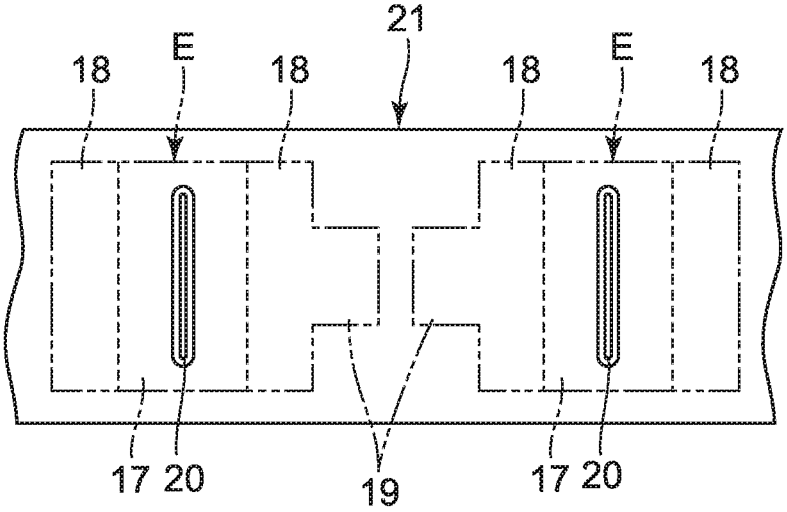
FIG. 9 is an enlarged plan view of the main part, showing a part of processes for manufacturing the terminal shown in FIG. 6B.

First, in a first step, a plurality of terminals 15 are fabricated at once, as shown in FIG. 9. That is, in a state where a plurality of groove sections 20 are extended in a predetermined direction, that is, a width direction orthogonal to a longitudinal direction of a metal plate 21 in FIG. 9, the plurality of terminals 15 are spaced apart from each other by a predetermined interval and are formed at once by press working.

In this state, for each of the plurality of groove sections 20, each of terminal areas E where the contact target section 17 of the terminal 15, the pair of reinforcing sections 18 on both sides thereof and the connection piece 19 extending from one of the reinforcing sections 18 are developed (a part indicated by a two-dot chain line in FIG. 9) is secured along the longitudinal direction of the strip-shaped metal plate 21, and the plurality of terminal areas E are punched at once by punching processing, as shown in FIG. 9.

Then, the plurality of terminals 15 in a state where the contact target section 17, the pair of reinforcing sections 18, and the connection piece 19 are developed are simultaneously formed. In addition, the pair of reinforcing sections 18 is folded toward a side opposite to an opening side of the groove section 20 on both sides of the contact target section 17 of this terminal 15 (a part indicated by a dotted line in FIG. 9). As a result, the terminal 15 shown in FIG. 6B is formed.

Figure 10A:
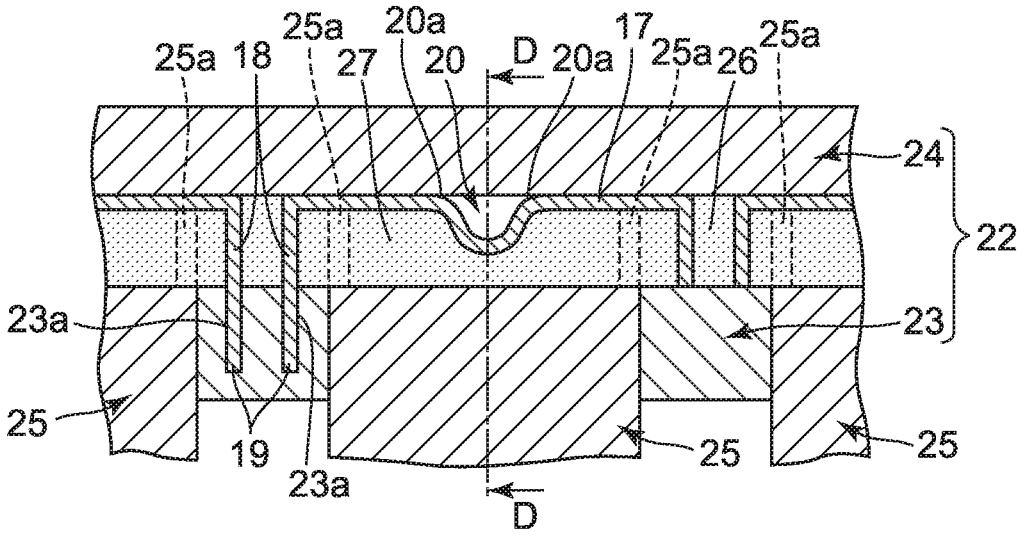
FIG. 10A is an enlarged cross-sectional view showing a main part of a mold for manufacturing the terminal section shown in FIGS. 8A to 8C.
Figure 10B:
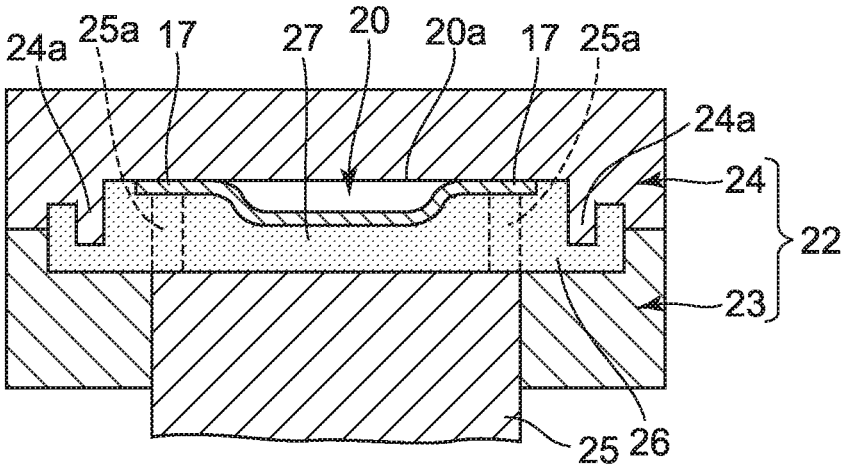
FIG. 10B is an enlarged cross-sectional view taken along line D-D in FIG. 10A.

Next, in a second step, the plurality of terminals 15 are fixed in a molding die 22, as shown in FIGS. 10A and 10B. The molding die 22 is structured to be provided with a first mold 23 and a second mold 24, which superimpose with each other. Therefore, firstly, the first mold 23 and the second mold 24 are demolded, and the plurality of terminals 15 are held within the molded first mold 23.

Here, the connection piece 19 protruding from one of the pair of reinforcing sections 18 of the terminal 15 is inserted into the holding hole 23*a* of the first mold 23. As a result, the plurality of terminals 15 are held in the first mold 23. In this state, the second mold 24 is superimposed on the first mold 23. Here, the frame-shaped protruding section 24*b* provided in the second mold 24 is arranged in a state of surrounding an outer periphery of the plurality of terminals 15.

As a result, the front surface which is the first surface of the contact target section 17 of the terminal 15 comes in contact with the inner surface of the second mold 24 except for the groove section 20. In this state, a pressing section 25 slidably provided in the first mold 23 is pushed into a space section 26 formed by the first mold 23 and the second mold 24, and a back surface which is a second surface of the contact target section 17 of the terminal 15 is pressed toward the inner surface of the second mold 24.

Figure 11:
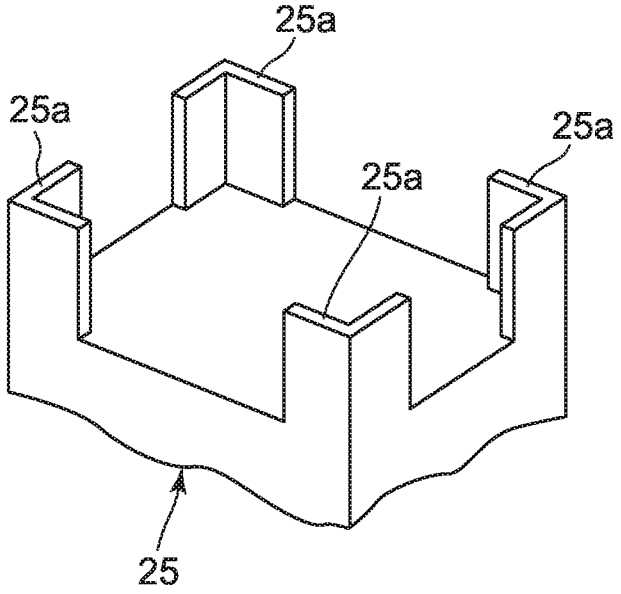
FIG. 11 is an enlarged perspective view of the main part, showing a pressing section of the mold shown in FIGS. 10A and 10B.
Figure 12:
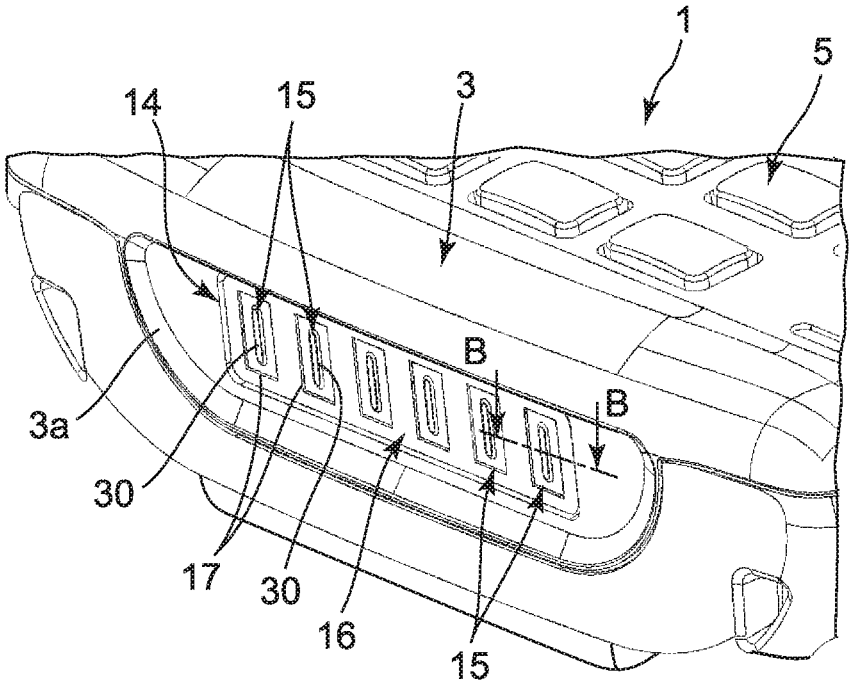
FIG. 12 is an enlarged perspective view of a main part, showing a lower end side of a portable terminal according to a second embodiment.

In this embodiment, the pressing section 25 has a cross-sectional shape formed in a quadrilateral square bar having a size slightly smaller than the contact target section 17 of the terminal 15, and is provided with abutting protrusions 25*a* at four corners of the tip portion thereof, as shown in FIG. 11. Therefore, when the pressing section 25 is pushed into the space section 26 between the first mold 23 and the second mold 24, the four abutting protrusions 25*a* press the four corners of the contact target section 17, which are located around the groove section 20 of the terminal 15, against the inner surface of the second mold 24.

As a result, the plurality of terminals 15 are fixed to the inside area between the first mold 23 and the second mold 24. In this state, a protruding length of the abutting protrusions 25*a* of the pressing section 25 is substantially equal to a length (height) in a bending direction of the reinforcing sections 18. Therefore, a space is formed between the inner surface of the pressing section 25 provided with the abutting protrusions 25*a* at the four corners and the back surface of the contact target section 17. This space is connected to the space section 26 through the abutting protrusions 25*a* at the four corners.

Then, in a third step, a resin 27 is injected into the space section 26 between the first mold 23 and the second mold 24, and the plurality of terminals 15 are molded to form the terminal section 14. That is, when the resin 27 is injected into the space section 26 between the first mold 23 and the second mold 24, the resin 27 covers an outer periphery of the pair of reinforcing sections 18 of the terminal 15 and is filled in the back surface side of the contact target section 17 through the abutting protrusions 25*a* located at the four corners of the pressing section 25.

As a result, the terminal 15, except the front surface of the contact target section 17 of the terminal 15, the groove section 20, and the connection piece 19, is molded by the resin 27. Therefore, the plurality of terminals 15 are molded at once by the resin 27, and the terminal holder 16 is formed. Here, the mounting groove 16*a* is formed surrounding the plurality of terminals 15, around the front surface of the terminal holder 16 by the frame-shaped protruding section 24*b* of the second mold 24. As a result, the terminal section 14 is formed.

In this state, after the molded resin 27 is cured, firstly, the pressing section 25 is pulled out from the first mold 23. Then, the first mold 23 and the second mold 24 are demolded, and the terminal section 14 which is a molded product is taken out from the molding die 22. As a result, the terminal section 14 in which the plurality of terminals 15 are embedded in the terminal holder 16 with them being arranged is manufactured. That is, in the terminal section 14, the front surface of the contact target section 17 of the terminal 15 and the groove section 20 are provided to be exposed on a front surface side of the terminal holder 16, and the connection piece 19 is provided to protrude to the back surface side of the terminal holder 16.

In addition, when the edge portion of the opening section 3*a* provided at the lower end portion of the device case 3 is engaged with the mounting groove 16*a* provided around the front surface of the terminal holder 16, each contact target section 17 of the plurality of terminals 15 is attached to the lower end portion of the device case 3 with it being exposed to the outside from the opening section 3*a* of the device case 3.

Next, an effect of the portable terminal 1 according to the first embodiment will be described.

When using the portable terminal 1, a user can input information by holding the device case 3 in his/her hand and operating the input section 5 by keys while viewing information displayed on the display section 4. The input information is displayed on the display section 4. In addition, when the side switch 6 of the device case 3 is operated, an optical reading section (not shown) provided at the upper end portion of the device case 3 is driven, and a bar code of an article can be read.

On the other hand, when this portable terminal 1 is to be mounted on the cradle 2 and electrically connected thereto, the portable terminal 1 is inserted obliquely from above into the fitting recessed section 8 of the cradle 2, and the portable terminal 1 is pushed into the fitting recessed section 8 of the cradle 2. Then, the terminal section 14 provided at the lower end portion of the portable terminal 1 corresponds to the connection section 10 provided in the base 7 of the cradle 2, and the plurality of terminals 15 in the terminal section 14 of the portable terminal 1 are respectively pressed against the plurality of contact pins 11 of this connection section 10.

More specifically, the plurality of contact pins 11 of the connection section 10 protrude to the inside of the fitting recessed section 8 through each opening section 8*a* provided at a bottom portion of the fitting recessed section 8 of the cradle 2. Therefore, when the portable terminal 1 is pushed into the fitting recessed section 8 of the cradle 2, the plurality of terminals 15 in the terminal section 14 of the portable terminal 1 are respectively pressed against each tip portion 11*a* of the plurality of contact pins 11.

Then, the plurality of leaf springs 12 of the connection section 10 are respectively flexed and deformed downward with the support bases 12*a* as the support point, and each tip portion 11*a* of each contact pin 11 slides with it being in elastic contact with each contact target section 17 of each terminal 15 in accordance with the flexural deformation of each of the leaf springs 12. That is, when the tip portion 11*a* of the contact pin 11 is to be pressed against the contact target section 17 of the terminal 15, the tip portion 11*a* of the contact pin 11 is pressed against the groove section 20 of the contact target section 17 by the spring force of the leaf springs 12.

Here, the tip portion 11*a* of the contact pin 11 is formed in a hemispherical shape or a curved shape, and the groove width of the groove section 20 of the contact target section 17 is formed smaller than the diameter of the tip portion 11*a*. Therefore, the tip portion 11*a* of the contact pin 11 butts against the edges 20*a* on both sides in the groove width direction of the groove section 20 of the contact target section 17 by the spring force of the leaf springs 12. As a result, the position of the tip portion 11*a* of the contact pin 11 in the groove width direction of the groove section 20 is controlled.

As described above, when the tip portion 11*a* of the contact pin 11 is pressed against the edges 20*a* on both sides in the groove width direction of the groove section 20 of the contact target section 17 and the position in the groove width direction is controlled, the tip portion 11*a* of the contact pin 11 comes in contact with two points of the two edges 20*a* on both sides in the groove width direction of the groove section 20. Therefore, the tip portion 11*a* of the contact pin 11 comes in contact with the contact target section 17 at two points and, in this state, slides along the groove section 20 in accordance with the flexural deformation of the leaf springs 12.

As a result, since each of the plurality of terminals 15 of the terminal section 14 and each of the plurality of contact pins 11 of the connection section 10 are conducted by the two-point contact, conductivity between the plurality of terminals 15 and the plurality of contact pins 11 becomes stable, the terminal section 14 of the portable terminal 1 and the connection section 10 of the cradle 2 are electrically connected to each other reliably, and reliability of connection performance is secured. Therefore, the portable terminal 1 is reliably and favorably charged by the cradle 2, and data exchange between the portable terminal 1 and the cradle 2 is reliably and favorably performed.

As described above, according to the terminal structure of this portable terminal 1, the groove section 20 extending in a predetermined direction is provided in the contact target section 17 with which the tip portion 11*a* of the contact pin 11 is brought into contact, and the tip portion 11*a* slides on the edge 20*a* of the groove section 20 along the groove section 20 by pressing force when the tip portion 11*a* is butted against the contact target section 17 so as to be brought into contact with the contact target section 17. According to this structure, reliability of connection performance can be secured by multi-point contact.

More specifically, in the terminal structure of this portable terminal 1, the tip portion 11*a* of the contact pin 11 is formed in a hemispherical shape or a curved shape so as to come in contact with each edge 20*a* on both sides of the groove section 20 and a diameter thereof is formed to be larger than the groove width of the groove section 20, thereby allowing the tip portion 11*a* to come in contact with each edge 20*a* on both sides of the groove section 20. As a result, the conductivity between the tip portion 11*a* of the contact pin 11 and the contact target section 17 can be stabilized, and therefore the reliability of connection performance between the contact pin 11 and the terminal 15 can be secured.

In addition, in the terminal structure of this portable terminal 1, the contact target section 17 is arranged and provided in the terminal holder 16 in a state where the front surface which is the first surface of the contact target section 17 located on the opening side of the groove section 20 is exposed. It is thereby possible to easily and favorably assemble the plurality of terminals 15 to the portable terminal 1. As a result, the plurality of terminals 15 can be connected to the plurality of contact pins 11 at once. Therefore, a large amount of data can be efficiently exchanged between the portable terminal 1 and the cradle 2.

Further, a method for manufacturing this terminal section 14 includes a first step for fabricating a terminal 15 in which a groove section 20 extending in a predetermined direction is provided in a front surface that is a first surface of a contact target section 17 with which a tip portion 11*a* of a contact pin 11 is brought into contact, a second step for superimposing a second mold 24 on a first mold 23 holding the terminal 15 and, in a state where the second mold 24 is in contact with the front surface of the contact target section 17, pressing a back surface that is a second surface of the contact target section 17 against the second mold 24 so as to fix the back surface to the second mold 24 by a pressing section 25, and a third step for injecting a resin 27 into a space section 26 formed in the first and second molds 23, 24 so as to mold the terminal 15 excluding the front surface of the contact target section 17. It is thereby possible to efficiently and easily manufacture the terminal section 14.

More specifically, in the first step, when the terminal 15 is to be fabricated in which the groove section 20 extending in a predetermined direction is provided in the front surface of the contact target section 17 with which the tip portion 11*a* of the contact pin 11 is brought into contact, a plurality of the groove sections 20 can be spaced apart from each other by a predetermined interval and formed at once by press working in a state of being extended in a predetermined direction in the strip-shaped metal plate 21.

In this state, for each of the plurality of grooves 20, each of the terminal areas E having a shape where the contact target section 17 of the terminal 15, the pair of reinforcing sections 18 on both sides thereof and the connection piece 19 extending from one of the reinforcing sections 18 are developed can be secured along the longitudinal direction of the strip-shaped metal plate 21, and the plurality of terminal areas E can be punched at once by punching processing.

Therefore, in the first step, the plurality of terminals 15 in which the contact target section 17, the pair of reinforcing sections 18, and the connection piece 19 are developed can be simultaneously formed, and therefore productivity is good. By the pair of reinforcing sections 18 being folded toward the side opposite to the opening side of the groove section 20 on both sides of the contact target section 17 of the terminal 15 in this developed state (a part indicated by a dotted line in FIG. 9), the terminal 15 can be easily formed.

In the second step, the terminal 15 formed in the first step is held by the first mold 23, the second mold 24 is superimposed on this first mold 23 and, in a state where the second mold 24 is in contact with the front surface of the contact target section 17 except for the groove section 20 of the terminal 15, the front surface of the contact target section 17 is pressed against the second mold 24 by a pressing section 25. It is thereby possible to reliably and favorably fix the terminal 15 to the mold 23 and the second mold 24. Here, by the connection piece 19 of the terminal 15 being held in the holding hole 23*a* of the first mold 23, the terminal 15 can be easily and favorably held in the first mold 23.

In addition, in this second step, the pressing section 25 is pressed against a plurality of portions on the back surface of the contact target section 17 located around the groove section 20 of the terminal 15, so that it is not pressed against the groove section 20. Moreover, the plurality of portions on the back surface of the contact target section 17 can be reliably pressed against the second mold 24 by the pressing section 25, and therefore the front surface of the contact target section 17 of the terminal 15 can be reliably and favorably brought into close contact with the second mold 24.

Here, the pressing section 25, which has a cross-sectional shape formed in a quadrilateral square rod having a size slightly smaller than the contact target section 17 of the terminal 15, is provided with abutting protrusions 25*a* at four corners of the tip portion thereof, and is structured to be slidable along a demolding direction with respect to the first mold 23. As a result, when the pressing section 25 is pushed into the space section 26 between the first mold 23 and the second mold 24, the four corners of the contact target section 17, which are located around the groove section 20 of the terminal 15, can be reliably pressed against the inner surface of the second mold 24 and, as a result, the plurality of terminals 15 can be reliably and firmly fixed to the inside area between the first mold 23 and the second mold 24.

In addition, in the pressing section 25, a protruding length of the abutting protrusions 25*a* thereof is formed to be substantially equal to a length (height) in a bending direction of the reinforcing sections 18. Therefore, a space can be formed between the inner surface of the pressing section 25 provided with the abutting protrusions 25*a* at the four corners and the back surface of the contact target section 17, and the space between the inner surface of each pressing section 25 and the back surface of the contact target section 17 can be connected to the space section 26 through the abutting protrusions 25*a* at the four corners.

In addition, in this second step, by a plurality of holding holes 23*a* being provided which hold the connection piece of the terminal 15 in the first mold 23, the plurality of terminals 15 can be arranged and held in the first mold 23. Moreover, in this second step, by a plurality of pressing sections 25 being slidably provided in the first mold 23, the plurality of terminals 15 can be fixed to the inside area between the first mold 23 and the second mold 24 at once.

Further, in the third step, the resin 27 is injected into the space section 26 formed in the first and second molds 23, 24, and each terminal 15 except the front surface of the contact target section 17 of each terminal 15 is molded to form the terminal holder 16. It is thereby possible to reliably and favorably cover each terminal 15 with the resin 27.

More specifically, when the resin 27 is injected into the space section 26 between the first mold 23 and the second mold 24, the outer periphery of the pair of reinforcing sections 18 of each terminal 15 can be covered with the resin 27 and, at the same time, the resin 27 can be poured and filled into the back surface side of the contact target section 17 through the abutting protrusions 25*a* located at the four corners of the pressing section 25.

Therefore, in this third step, each terminal 15 can be reliably and favorably molded by the resin 27 except for the front surface of the contact target section 17, the groove section 20, and the connection piece 19 of each terminal 15 and, at the same time, the plurality of terminals 15 fixed between the first mold 23 and the second mold 24 can be molded at once with the resin 27 so as to form the terminal holder 16, and therefore the terminal section 14 in which the plurality of terminals 15 are arranged can be easily and efficiently formed.

In the first embodiment described above, the pressing section 25 that presses and fixes the contact target section 17 of each terminal 15 held in the first mold 23 of the molding die 22 to the second mold 24 is slidably provided in the first mold 23. However, the present invention is not limited thereto. For example, the pressing section 25 may be integrally provided in the first mold 23.

Also, in the first embodiment described above, the tip portion 11*a* of the contact pin 11 comes in contact with the edges 20*a* on both sides of the groove section 20 of the contact target section 17 at two points and slides. However, the present invention is not limited thereto. In the present invention, for example, a structure may be adopted in which the groove section is formed by forming a rectangular recessed section in the contact target section 17 and a depth thereof is formed to be shallow, whereby the tip portion 11*a* of the contact pin 11 comes in contact with the edges on both sides of the groove section of the contact target section 17, further comes in contact with a bottom portion of the groove section, and thereby slides with it being in contact at three points.

Further, in the first embodiment described above, the present invention is applied to the portable terminal 1. However, the present invention is not limited thereto, and may be applied to an electronic device such as a mobile phone.

While the first embodiment of the present invention has been described above, the present invention is not limited thereto and includes the invention described in the claims and the equivalent scope thereof.

Hereinafter, a second embodiment in which the present invention is applied to a portable terminal will be described with reference to FIGS. 12 to 17B. Note that sections corresponding to those of the first embodiment in the drawings are provided with the same reference numerals for description.

In the second embodiment, a protruding section 30 is provided instead of the groove section 20 in the contact target section 17 of the first embodiment. Hereinafter, in the second embodiment, sections different from those of the first embodiment will be mainly described.

As shown in FIGS. 12 to 15C, the contact target section 17 in the second embodiment is a section where a front surface that is a first surface thereof is brought into contact with the tip portion 11*a* of the contact pin 11 of the connection section 10 and where the tip portion 11*a* slides, and is formed in a quadrangular flat plate shape. This feature is the same as that of the first embodiment. However, in the contact target section 17 of the second embodiment, the protruding section 30 extending in a longitudinal direction in which the tip portion 11*a* of the contact pin 11 slides is provided protruding in a mountain shape on the front surface side of the contact target section 17.

Figure 13A:
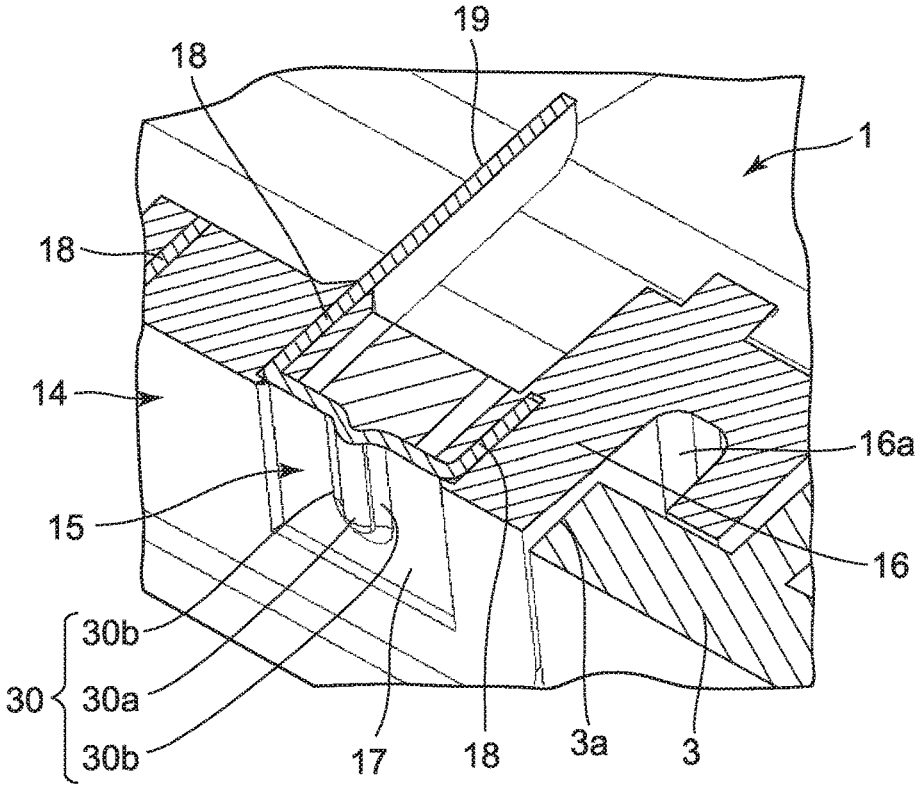
FIG. 13A is an enlarged perspective view showing a terminal section of the portable terminal shown in FIG. 12 with the main part being cut along arrows B-B.

More specifically, the protruding section 30 is provided extending on the longitudinal center line on the front surface of the contact target section 17, as shown in FIGS. 13A and 138. In this protruding section 30, a length in a longitudinal direction that is an extending direction thereof is set to be equal to or slightly longer than a length at which the tip portion 11*a* of the contact pin 11 slides.

Figure 13B:
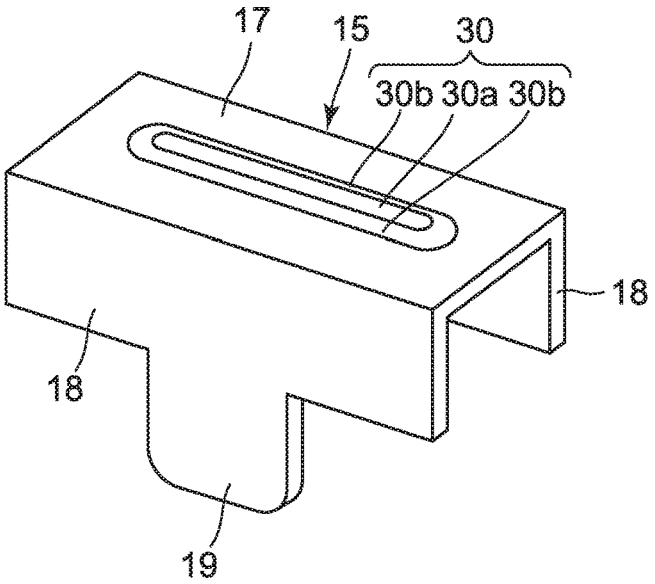
FIG. 13B is an enlarged perspective view showing a terminal of the terminal section of the portable terminal shown in FIG. 12.
Figure 14:
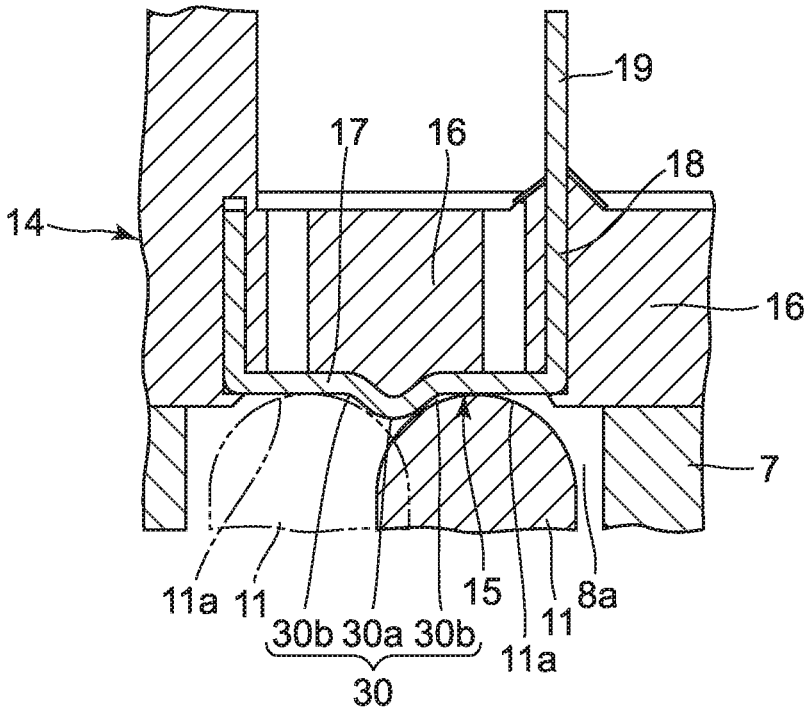
FIG. 14 is an enlarged cross-sectional view of the main part, showing a state where a contact pin is pressed against the terminal shown in FIGS. 13A and 13B.
Figure 15A:
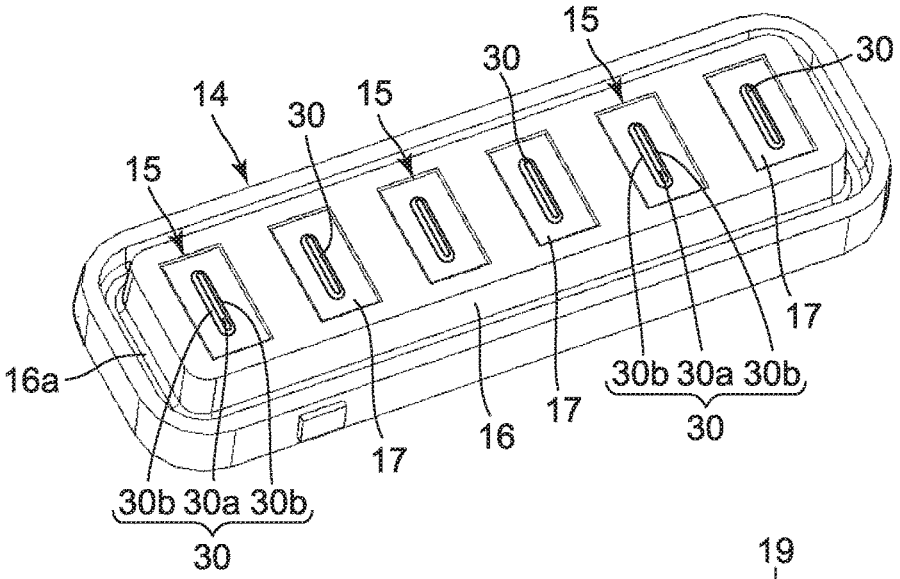
FIG. 15A is an enlarged perspective view of a terminal section of the portable terminal shown in FIG. 12 when viewed from a front surface side.
Figure 15B:
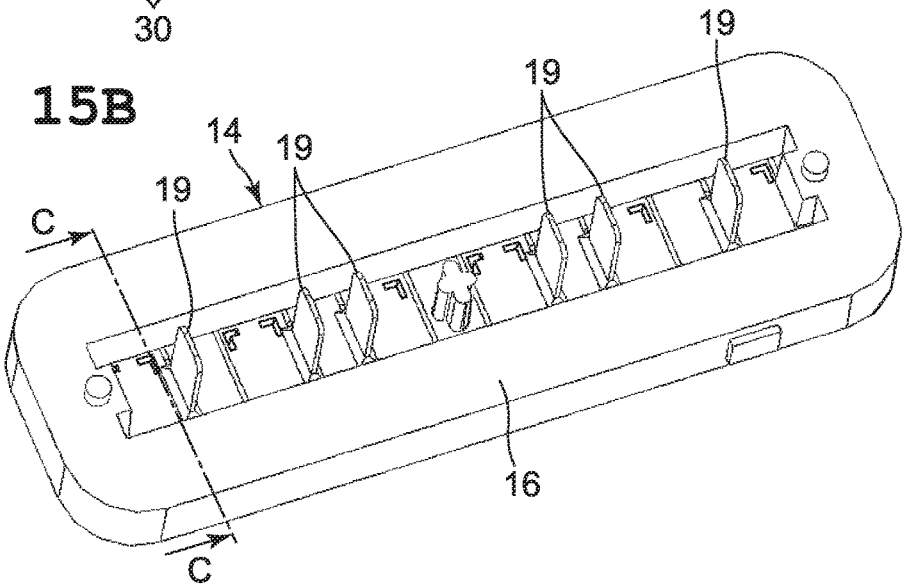
FIG. 15B is an enlarged perspective view of the terminal section of the portable terminal shown in FIG. 12 when viewed from a back surface side.
Figure 15C:
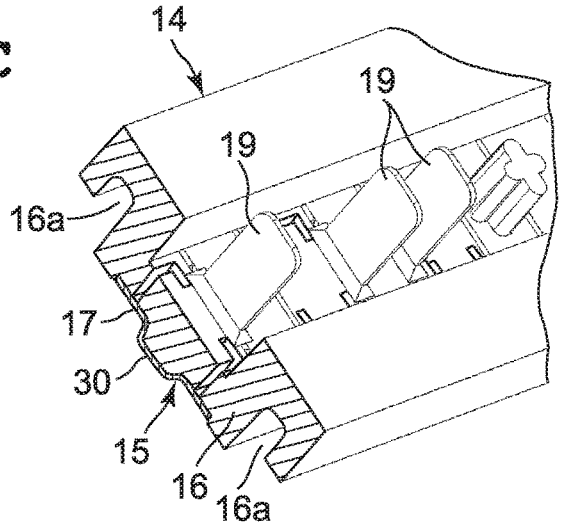
FIG. 15C is an enlarged perspective view of the main part taken along line C-C in FIG. 15B.

In addition, in this protruding section 30, a cross-sectional shape in a lateral direction (width direction) orthogonal to the longitudinal direction that is the extending direction thereof is formed in a circular-arc shape, as shown in FIGS. 13A, 13B and 14. A curvature thereof may be smaller but should preferably be larger than that of the tip portion 11*a* of the contact pin 11. In other words, it is desirable that a curvature radius of a top portion 30*a* of the protruding section 30 is set to be smaller than that of the tip portion 11*a*.

Therefore, the protruding section 30 is formed such that the tip portion 11*a* of the contact pin 11 easily comes in contact with the top portion 30*a*, and easily becomes unstable when it comes in contact with the top portion 30*a*, as shown in FIGS. 13A, 13B and 14. That is, the contact pin 11 is structured such that the tip portion 11*a* thereof reliably butts against the top portion 30*a* of the protruding section 30 of the contact target section 17 and, when butting, this tip portion 11*a* unpredictably proceeds toward a direction of one of the roots 30*b* located on both sides with the top portion 30*a* of the protruding section 30 as a boundary by the spring force of the leaf springs 12.

In addition, the protruding section 30 is provided such that a root 30*b* of each of its skirt areas located on both sides of the top portion 30*a* extends in parallel to the extending direction of the protruding section 30, as shown in FIG. 14. In addition, in the protruding section 30, the skirt areas extending from the top portion 30*a* to the root 30*b* on both sides respectively form a recessed curved surface having a circular-arc shape or a curved shape.

As shown in FIG. 14, the recessed curved surface of each skirt area of the protruding section 30 is formed such that the curvature thereof is larger than that of the tip portion 11*a*. That is, the curvature radius of the recessed curved surface is smaller than that of the tip portion 11*a*. Therefore, the tip portion 11*a* of the contact pin 11 is structured to make two-point contact with the contact target section 17 in the skirt area on one side of the protruding section 30.

More specifically, the tip portion 11*a* of the contact pin 11 is structured to, after being butted against the top portion 30*a* of the protruding section 30 of the contact target section 17 and sliding down to the skirt area on one side of the protruding section 30, come in contact with two points which are a point in the skirt area located on the top portion 30*a* side and a point in the skirt area located on the root 30*b* side of the protruding section 30 so as to come in contact with the contact target section 17 at two points, and slide on one side of the protruding section 30 in this state along the protruding section 30, as shown in FIG. 14.

Next, a procedure for manufacturing the terminal section 14 of the portable terminal 1 in the second embodiment will be described with reference to FIGS. 16 to 17B. The second embodiment is different from the first embodiment in that a relief recessed section 24*a* is provided in the second mold 24.

Figure 16:
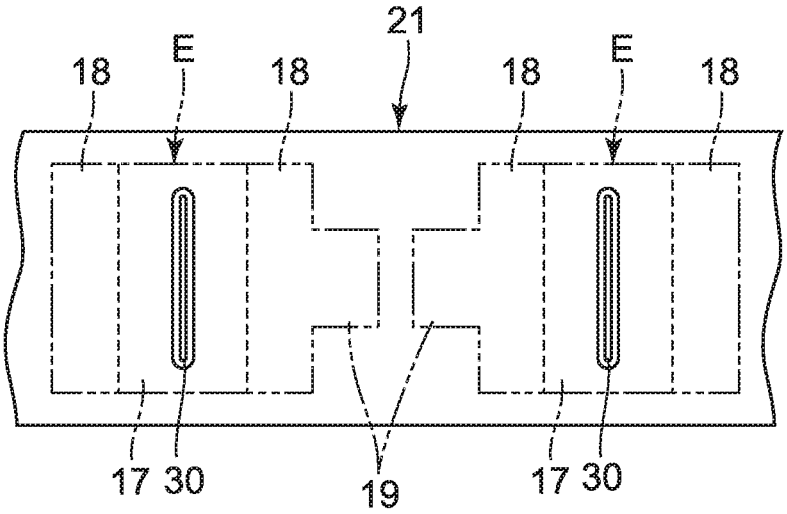
FIG. 16 is an enlarged plan view of the main part, showing a part of processes for manufacturing the terminal shown in FIG. 13B.

First, in a first step, a plurality of terminals 15 are fabricated at once, as shown in FIG. 16. That is, in a state where a plurality of protruding sections 30 are extended in a predetermined direction, that is, in a width direction orthogonal to the longitudinal direction of the metal plate 21 in FIG. 16, the plurality of terminals 15 are spaced apart from each other by a predetermined interval and are formed at once by press working.

In this state, for each of the plurality of protruding sections 30, each of the terminal areas E having a shape where the contact target section 17 of the terminal 15, the pair of reinforcing sections 18 on both sides thereof, and the connection piece 19 extending from one of the reinforcing sections 18 are developed (a part indicated by a two-dot chain line in FIG. 16) is secured along the longitudinal direction of the strip-shaped metal plate 21, and the plurality of terminal areas E are punched at once by punching processing.

Then, the plurality of terminals 15 in a state where the contact target section 17, the pair of reinforcing sections 18, and the connection piece 19 are developed are simultaneously formed. In addition, the pair of reinforcing sections 18 is folded toward a side opposite to a protruding direction of the protruding section 30 on both sides of the contact target section 17 of this terminal 15 (an area indicated by a dotted line in FIG. 16). As a result, the terminal 15 shown in FIG. 13B is formed.

Figure 17A:
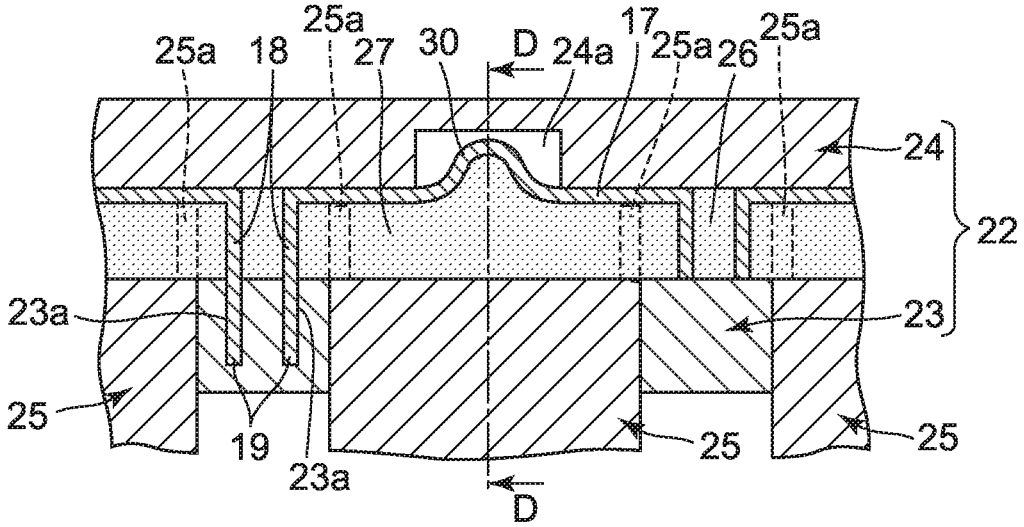
FIG. 17A is an enlarged cross-sectional view showing a main part of a mold for manufacturing the terminal section shown in FIGS. 15A to 15C.
Figure 17B:
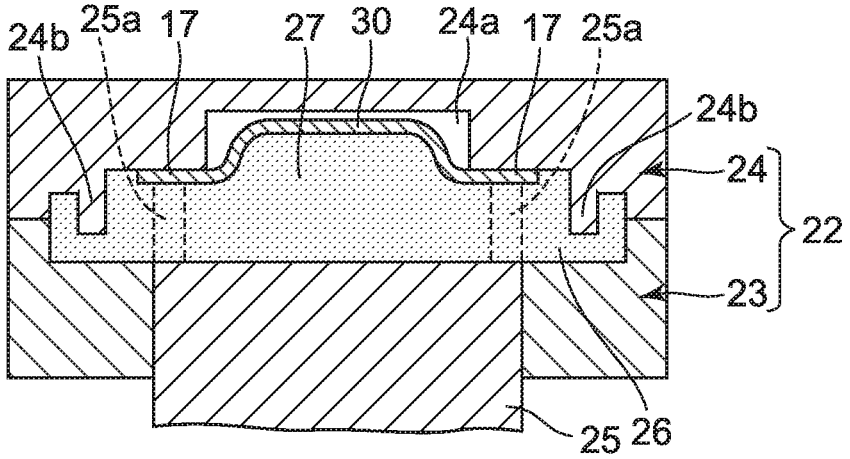
FIG. 17B is an enlarged cross-sectional view taken along line D-D in FIG. 17A.

Next, in a second step, the plurality of terminals 15 are fixed in a molding die 22, as shown in FIGS. 17A and 17B. The molding die 22 is structured to be provided with a first mold 23 and a second mold 24, which superimpose with each other. Therefore, firstly, the first mold 23 and the second mold 24 are demolded, and the plurality of terminals 15 are held in the molded first mold 23. Here, the connection piece 19 protruding from one of the pair of reinforcing sections 18 of the terminal 15 is inserted into the holding hole 23*a* of the first mold 23. As a result, the plurality of terminals 15 are held in the first mold 23.

In this state, the second mold 24 is superimposed on the first mold 23. Here, the frame-shaped protruding section 24*b* provided in the second mold 24 is arranged in a state of surrounding an outer periphery of the plurality of terminals 15 and, at the same time, each protruding section 30 of the plurality of terminals 15 is respectively arranged in the plurality of relief recessed sections 24*a* provided in the second mold 24.

As a result, the front surface which is the first surface of the contact target section 17 of the terminal 15 comes in contact with the inner surface of the second mold 24 except for the protruding section 30. In this state, a pressing section 25 slidably provided in the first mold 23 is pushed into a space section 26 formed by the first mold 23 and the second mold 24, and a back surface which is a second surface of the contact target section 17 of the terminal 15 is pressed toward the inner surface of the second mold 24. Note that the pressing section 25 has a shape shown in FIG. 11.

As a result, the plurality of terminals 15 are fixed to the inside area between the first mold 23 and the second mold 24. In this state, a protruding length of the abutting protrusions 25*a* of the pressing section 25 is formed to be substantially equal to a length (height) in a bending direction of the reinforcing sections 18. Therefore, the space is formed between the inner surface of the pressing section 25 provided with the abutting protrusions 25*a* at the four corners and the back surface of the contact target section 17. This space communicates with the space section 26 through the abutting protrusions 25*a* at the four corners.

Then, in a third step, the resin 27 is injected into the space section 26 between the first mold 23 and the second mold 24, and the plurality of terminals 15 are molded to form the terminal section 14. That is, when the resin 27 is injected into the space section 26 between the first mold 23 and the second mold 24, the resin 27 covers the outer periphery of the pair of reinforcing sections 18 of the terminal 15 and, at the same time, is filled in the back surface side of the contact target section 17 through the abutting protrusions 25*a* located at the four corners of the pressing section 25.

As a result, the terminal 15 excluding the front surface of the contact target section 17 of the terminal 15, the protruding section 30, and the connection piece 19 is molded by the resin 27. Therefore, the plurality of terminals 15 are molded at once by the resin 27, and the terminal holder 16 is formed. Here, the mounting groove 16*a* is formed surrounding the plurality of terminals 15, around the front surface of the terminal holder 16 by the frame-shaped protruding section 24*b* of the second mold 24. As a result, the terminal section 14 is formed.

In this state, after the molded resin 27 is cured, first, the pressing section 25 is pulled out from the first mold 23. Then, the first mold 23 and the second mold 24 are demolded, and the terminal section 14 which is a molded product is taken out from the molding die 22. As a result, the terminal section 14 in which the plurality of terminals 15 are embedded in the terminal holder 16 in a state of being arranged is manufactured. That is, in the terminal section 14, the front surface of the contact target section 17 of the terminal 15 and the protruding section 30 are provided so as to be exposed on a front surface side of the terminal holder 16, and the connection piece 19 is provided so as to protrude to the back surface side of the terminal holder 16.

In addition, when the edge portion of the opening section 3*a* provided at the lower end portion of the device case 3 is engaged with the mounting groove 16*a* provided around the front surface of the terminal holder 16, each contact target section 17 of the plurality of terminals 15 is attached to the lower end portion of the device case 3 with it being exposed to the outside from the opening section 3*a* of the device case 3.

Next, an effect of the portable terminal 1 according to the second embodiment will be described. Note that descriptions for sections common to those of the first embodiment will be omitted.

When this portable terminal 1 is to be mounted on the cradle 2 and electrically connected thereto, the portable terminal 1 is inserted obliquely from above into the fitting recessed section 8 of the cradle 2, and the portable terminal 1 is pushed into the fitting recessed section 8 of the cradle 2. Then, the terminal section 14 provided at the lower end portion of the portable terminal 1 corresponds to the connection section 10 provided in the base 7 of the cradle 2, and the plurality of terminals 15 in the terminal section 14 of the portable terminal 1 are respectively pressed against the plurality of contact pins 11 of this connection section 10.

More specifically, the plurality of contact pins 11 of the connection section 10 protrude to the inside of the fitting recessed section 8 through each opening section 8*a* provided at the bottom portion of the fitting recessed section 8 of the cradle 2. Therefore, when the portable terminal 1 is pushed into the fitting recessed section 8 of the cradle 2, the plurality of terminals 15 in the terminal section 14 of the portable terminal 1 are respectively pressed against each tip portion 11*a* of the plurality of contact pins 11.

Then, the plurality of leaf springs 12 of the connection section 10 are respectively flexed and deformed downward with the support bases 12*a* as the support point, and each tip portion 11*a* of each contact pin 11 slides with it being in elastic contact with each contact target section 17 of each terminal 15 in accordance with the flexural deformation of each of the leaf springs 12. That is, when the tip portion 11*a* of the contact pin 11 is to be pressed against the contact target section 17 of the terminal 15, first, the tip portion 11*a* of the contact pin 11 is pressed against the top portion 30*a* of the protruding section 30 of the contact target section 17 by the spring force of the leaf springs 12.

Here, the tip portion 11*a* of the contact pin 11 is formed in a hemispherical shape or a curved shape, the top portion 30*a* of the protruding section 30 of the contact target section 17 is formed in a circular-arc, and a curvature of the top portion 30*a* is formed larger than that of the tip portion 11*a* of the contact pin 11. As a result, the tip portion 11*a* of the contact pin 11 is reliably butted against the top portion 30*a* of the protruding section 30 and, when it is butted, becomes unstable.

Therefore, in this state, when the tip portion 11*a* of the contact pin 11 is pressed against the top portion 30*a* of the protruding section 30 of the contact target section 17 by the spring force of the leaf springs 12, the tip portion 11*a* of the contact pin 11 slides down unpredictably in a direction of either one of the roots 30*b* on both sides with the top portion 30*a* as the boundary.

As described above, when the tip portion 11*a* of the contact pin 11 slides down to the skirt area on one side of the protruding section 30 of the contact target section 17, the leaf spring 12 is twisted and the tip portion 11*a* comes in contact with two points which are a point in the skirt area located on the top portion 30*a* side and a point in the skirt area located on the root 30*b* side of the protruding section 30. That is, in the protruding section 30, the skirt areas extending from the top portion 30*a* to the root 30*b* on both sides respectively form a recessed curved surface having a circular-arc shape or a curved shape, and the respective curvatures of these recessed curved surfaces are formed larger than that of the tip portion 11*a*.

Therefore, when the tip portion 11*a* of the contact pin 11 butts against the top portion 30*a* of the protruding section 30 of the contact target section 17 and slides down to the skirt area on one side of the protruding section 30, the tip portion 11*a* comes in contact with two points which are a point in the skirt area located on the top portion 30*a* side and a point in the skirt area located on the root 30*b* side. As a result, the tip portion 11*a* of the contact pin 11 comes in contact with the contact target section 17 at two points and, in this state, slides on one side of the protruding section 30 along the protruding section 30 in accordance with the flexural deformation of the leaf springs 12.

As a result, since the plurality of terminals 15 of the terminal section 14 and the plurality of contact pins 11 of the connection section 10 are conducted by the two-point contact, the conductivity between the plurality of terminals 15 and the plurality of contact pins 11 becomes stable, the terminal section 14 of the portable terminal 1 and the connection section 10 of the cradle 2 are electrically connected to each other reliably, and reliability of connection performance is secured. Therefore, the portable terminal 1 is reliably and favorably charged by the cradle 2, and data exchange between the portable terminal 1 and the cradle 2 is reliably and favorably performed.

As described above, according to the terminal structure of this portable terminal 1, the protruding section 30 extending in a predetermined direction is provided in the contact target section 17 with which the tip portion 11*a* of the contact pin 11 is brought into contact, and the tip portion 11*a* slides one side of the protruding section 30 along the protruding section 30 by pressing force when the tip portion 11*a* of the contact pin 11 is butted against the contact target section 17 to be brought into contact with the contact target section 17, whereby the tip portion 11*a* comes in contact with a plurality of points of the contact target section 17. As a result, reliability of connection performance can be secured.

More specifically, in the terminal structure of this portable terminal 1, the tip portion 11*a* of the contact pin 11 is formed in a hemispherical shape or a curved shape and comes in two-point contact with the contact target section 17 on one side of the protruding section 30. It is thereby possible to stabilize conductivity between the tip portion 11*a* of the contact pin 11 and the contact target section 17. As a result, the reliability of connection performance between the contact pin 11 and the terminal 15 can be secured.

In addition, in the terminal structure of this portable terminal 1, the tip portion 11*a* is butted against a top portion 30*a* of the protruding section 30 prior to the tip portion 11*a* sliding on one side of the protruding section 30 along the protruding section 30 when the tip portion 11*a* is butted against the contact target section 17. The tip portion 11*a* which is in contact with the protruding section 30 thereby becomes unstable, and therefore the tip portion 11*a* can be moved in a direction of one of the sides of the protruding section 30 with the top portion 30*a* as the boundary.

More specifically, the cross-sectional shape of the protruding section 30 in the width direction is formed in a circular-arc shape and the curvature of the cross-sectional surface is formed larger than the tip portion 11*a*, whereby the tip portion 11*a* easily butts against the top portion 30*a* of the protruding section 30 and, when the tip portion 11*a* butts, the tip portion 11*a* becomes unstable. Therefore, the tip portion 11*a* can be reliably and favorably moved in a direction of one of the sides of the protruding section 30 with the top portion 30*a* as the boundary.

In addition, the protruding section 30 is provided such that the roots 30*b* thereof on both sides extend in parallel to a predetermined direction, and the tip portion 11*a* unpredictably proceeds toward a direction of one of the roots 3 on both sides after butting against the top portion 30*a* of the protruding section 30, whereby the tip portion 11*a* to moves to one side of the roots 30*b* on both sides. As a result, the tip portion 11*a* can be reliably and favorably slid on one side of the protruding section 30 along the protruding section 30.

In addition, the protruding section 30 is formed such that each of its skirt areas extending from the top portion 30*a* to the roots 30*b* on both sides forms a recessed curved surface having a circular-arc or curved shape, and the curvature of the recessed curved surface is larger than that of the tip portion 11*a*, thereby allowing the tip portion 11*a* to reliably come in contact with two points which are a point in the skirt area located on the top portion 30*a* side and a point in the skirt area located on the root 30*b* side when moving to the skirt area on one side of the roots 30*b* located on both sides.

As a result, in a state of being in contact with the two points of the contact target section 17, the tip portion 11*a* can be reliably and favorably slid on one side of the protruding section 30 along the protruding section 30. Therefore, in the terminal structure of this portable terminal 1, the conductivity between the tip portion 11*a* of the contact pin 11 and the contact target section 17 can be further stabilized and, at the same time, reliability in a conductive state between the tip portion 11*a* of the contact pin 11 and the contact target section 17 can be secured. As a result, the reliability of the connection performance between the contact pin 11 and the terminal 15 can be further enhanced.

Further, in the terminal structure of this portable terminal 1, the contact target section 17 is arranged and provided in the terminal holder 16 in a state where the front surface which is the first surface of the contact target section 17 from which the protruding section 30 protrudes and the protruding section 30 are exposed. It is thereby possible to easily and favorably assemble the plurality of terminals 15 to the portable terminal 1. As a result, the plurality of contact target sections 17 can be connected to the plurality of contact pins 11 at once. Therefore, a large amount of data can be efficiently exchanged between the portable terminal 1 and the cradle 2.

In addition, a method for manufacturing the terminal section 14 includes a first step for fabricating the terminal 15 in which the protruding section 30 extending in a predetermined direction is provided in the first surface of the contact target section 17 with which the tip portion 11*a* of the contact pin 11 is brought into contact, a second step for superimposing the second mold 24 on the first mold 23 holding the terminal 15 and, in a state where the second mold 24 is in contact with the front surface of the contact target section 17 except for the protruding section 30, pressing a back surface which is the second surface of the contact target section 17 against the second mold 24 so as to fix the back surface to the second mold 24 by the pressing section 25, and a third step for injecting the resin 27 into the space section 26 formed in the first and second molds 23, 24 to mold the terminal 15 excluding the front surface of the contact target section 17 and the protruding section 30. It is thereby possible to efficiently and easily manufacture the terminal section 14.

More specifically, in the first step, when the terminal 15 is to be fabricated in which the protruding section 30 extending in a predetermined direction is provided in the front surface of the contact target section 17 with which the tip portion 11*a* of the contact pin 11 is brought into contact, the plurality of the protruding sections 30 can be spaced apart from each other by a predetermined interval and formed at once by press working with them being extended in a predetermined direction in the strip-shaped metal plate 21.

In this state, for each of the plurality of protruding sections 30, each of the terminal areas E having a shape where the contact target section 17 of the terminal 15, the pair of reinforcing sections 18 on both sides thereof, and the connection piece 19 extending from one of the reinforcing sections 18 are developed can be secured along the longitudinal direction of the strip-shaped metal plate 21, and the plurality of terminal areas E can be punched at once by punching processing.

Therefore, in the first step, the plurality of terminals 15 in which the contact target section 17, the pair of the reinforcing sections 18, and the connection piece 19 are developed can be simultaneously formed. By folding the pair of the reinforcing sections 18 toward the side opposite to the protruding direction of the protruding section 30 on both sides of the contact target section 17 of the terminal 15 in this developed state (a part indicated by a dotted line in FIG. 16), the terminal 15 can be easily formed.

In addition, in the second step, the terminal 15 formed in the first step is held by the first mold 23, the second mold 24 is superimposed on this first mold 23 and, in a state where the second mold 24 is in contact with the front surface of the contact target section 17 except for the protruding section 30 of the terminal 15, the front surface of the contact target section 17 is pressed against the second mold 24 by a pressing section 25. It is thereby possible to reliably and favorably fix the terminal 15 to the mold 23 and the second mold 24.

Here, in the second step, by the connection piece 19 of the terminal 15 being held in the holding hole 23*a* of the first mold 23, the terminal 15 can be easily and favorably held in the first mold 23. In addition, in this second step, by the protruding section 30 of the terminal 15 being arranged in the relief recess section 24*a* provided in the second mold, the second mold 24 can be brought into close contact with the front surface of the contact target section 17 of the terminal 15 without crushing the protruding section 30.

In addition, in this second step, the pressing section 25 is pressed against a plurality of portions on the back surface of the contact target section 17 located around the protruding section 30 of the terminal 15, and thereby is not pressed against the protruding section 30. Moreover, the plurality of portions on the back surface of the contact target section 17 can be reliably pressed against the second mold 24 by the pressing section 25, and therefore the front surface of the contact target section 17 of the terminal 15 can be reliably and favorably brought into close contact with the second mold 24.

Here, the pressing section 25, which has a cross-sectional shape formed in a quadrilateral square bar having a size slightly smaller than the contact target section 17 of the terminal 15, is provided with abutting protrusions 25*a* at four corners of the tip portion thereof, and is structured to be slidable along a demolding direction with respect to the first mold 23. As a result, when the pressing section 25 is pushed into the space section 26 between the first mold 23 and the second mold 24, the four corners of the contact target section 17, which are located around the protruding section 30 of the terminal 15, can be reliably pressed against the inner surface of the second mold 24 by the abutting protrusions 25*a* at the four corners and, as a result, the plurality of terminals 15 can be reliably and firmly fixed to the inside area between the first mold 23 and the second mold 24.

In addition, in the pressing section 25, a protruding length of the abutting protrusions 25*a* thereof is formed to be substantially equal to a length (height) in a bending direction of the reinforcing sections 18. Therefore, a space can be formed between the inner surface of the pressing section 25 provided with the abutting protrusions 25*a* at the four corners and the back surface of the contact target section 17, and the space between the inner surface of each pressing section 25 and the back surface of the contact target section 17 can be connected to the space section 26 through the abutting protrusions 25*a* at the four corners.

In addition, in this second step, by a plurality of holding holes 23*a* being provided which hold the connection piece of the terminal 15 in the first mold 23 and, at the same time, a plurality of relief recessed sections 24*a* where the protruding section 30 of the terminal 15 is arranged being provided in the second mold, the plurality of terminals 15 can be arranged and held in the first mold 23. Moreover, in this second step, by a plurality of pressing sections 25 being slidably provided in the first mold 23, the plurality of terminals 15 can be fixed to the inside area between the first mold 23 and the second mold 24 at once.

Further, in the third step, the resin 27 is injected into the space section 26 formed in the first and second molds 23, 24, and each terminal 15 except the front surface of the contact target section 17 and the protruding section 30 of each terminal 15 is molded to form the terminal holder 16. It is thereby possible to reliably and favorably cover each terminal 15 with the resin 27. That is, when the resin 27 is injected into the space section 26 inside between the first mold 23 and the second mold 24, the outer periphery of the pair of reinforcing sections 18 of each terminal 15 can be covered with the resin 27 and, at the same time, the resin 27 can be poured and filled into the back surface side of the contact target section 17 through the abutting protrusions 25*a* located at the four corners of the pressing section 25.

Therefore, in this third step, each terminal 15 can be reliably and favorably molded by the resin 27 except for the front surface of the contact target section 17, the protruding section 30, and the connection piece 19 of each terminal 15. In addition, the plurality of terminals 15 fixed between the first mold 23 and the second mold 24 can be molded at once with the resin 27 to form the terminal holder 16. Therefore, the terminal section 14 in which the plurality of terminals 15 are arranged can be easily and efficiently formed.

In the second embodiment described above, the pressing section 25 that presses and fixes the contact target section 17 of each terminal 15 held in the first mold 23 of the molding die 22 to the second mold 24 is slidably provided in the first mold 23. However, the present invention is not limited thereto. For example, the pressing section 25 may be integrally provided in the first mold 23.

Also, in the second embodiment described above, the present invention is applied to the portable terminal 1. However, the present invention is not limited thereto, and may be applied to an electronic device such as a mobile phone.

While the second embodiment of the present invention has been described above, the present invention is not limited thereto and includes the invention described in the claims and the equivalent scope thereof.

Next, a third embodiment in which the present invention is applied to a portable terminal will be described with reference to FIG. 18 to FIG. 23B. Note that sections corresponding to those of the first embodiment in the drawings are provided with the same reference numerals for description.

In the third embodiment, a flat surface 17*a* and a recessed section 40 are provided instead of the groove section 20 in the contact target section 17 of the first embodiment. Hereinafter, in the third embodiment, sections different from those of the first embodiment will be mainly described.

As shown in FIGS. 18 to 21C, the contact target section 17 in the third embodiment is a section where a front surface that is a first surface thereof is brought into contact with the tip portion 11*a* of the contact pin 11 of the connection section 10 and where the tip portion 11*a* slides, and is formed in a quadrangular flat plate shape. This feature is the same as that of the first embodiment. However, in the contact target section 17 of the third embodiment, the flat surface 17*a* and the recessed section 40 are provided in the front surface which is the first surface thereof.

Figure 19A:
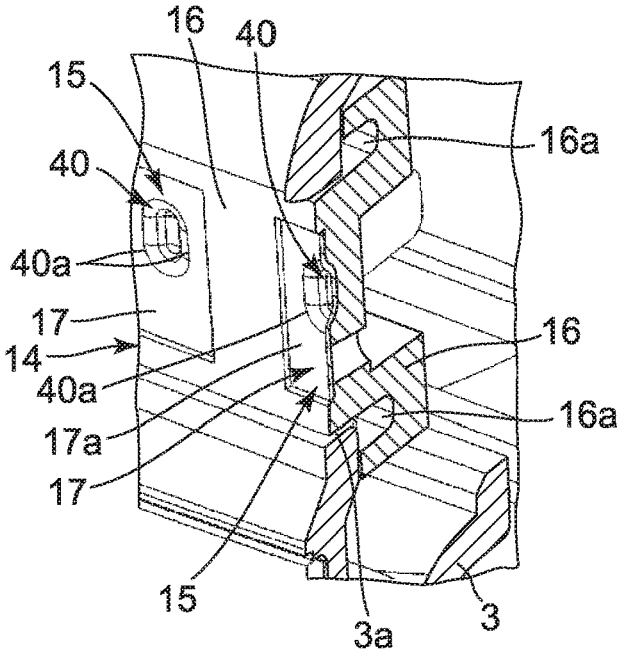
FIG. 19A is an enlarged perspective view showing a terminal section of the portable terminal shown in FIG. 18 with the main part being cut along line B-B.
Figure 19B:
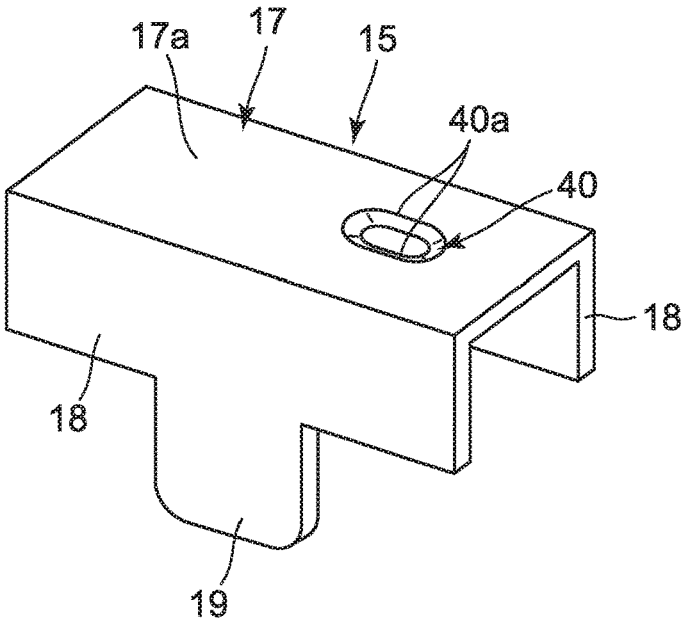
FIG. 19B is an enlarged perspective view showing a terminal of the terminal section of the portable terminal shown in FIG. 18.

As shown in FIGS. 19A and 19B, in this contact target section 17, the recessed section 40 which is a position control section is provided at a predetermined position, that is, a position deviated from a central portion of the contact target section 17 in the sliding area where the tip portion 11*a* of the contact pin 11 slides with respect to the front surface of the contact target section 17.

Figure 18:
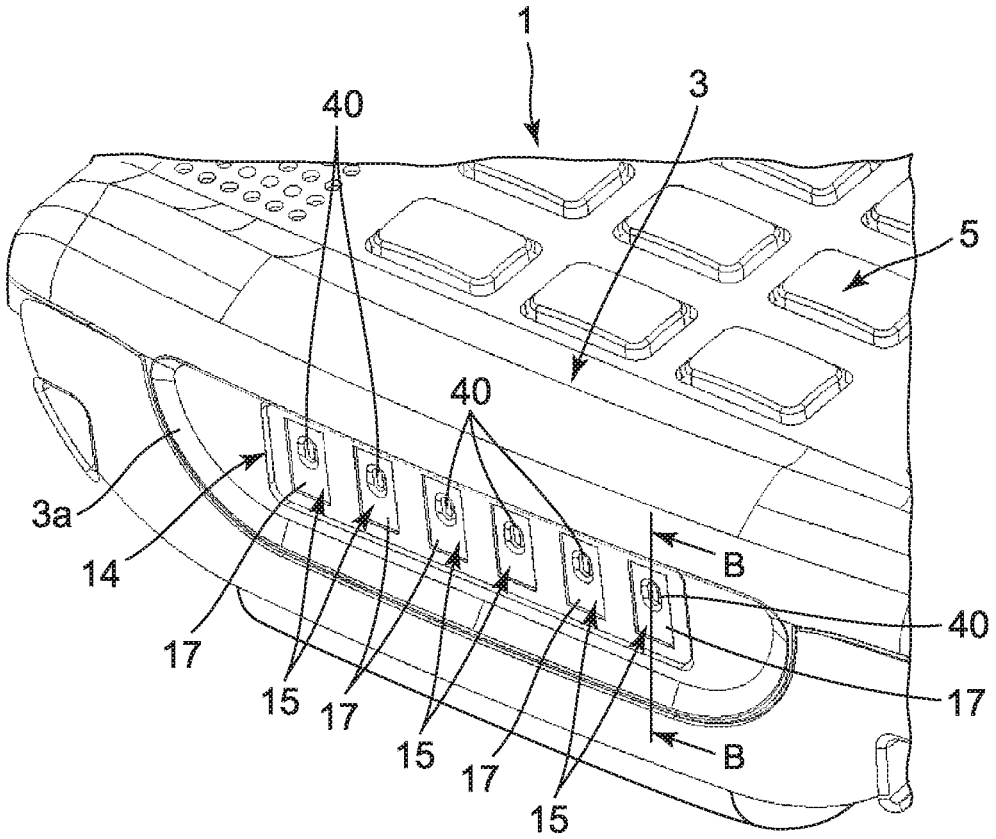
FIG. 18 is an enlarged perspective view of a main part, showing a lower end side of a portable terminal according to a third embodiment.
Figure 20:
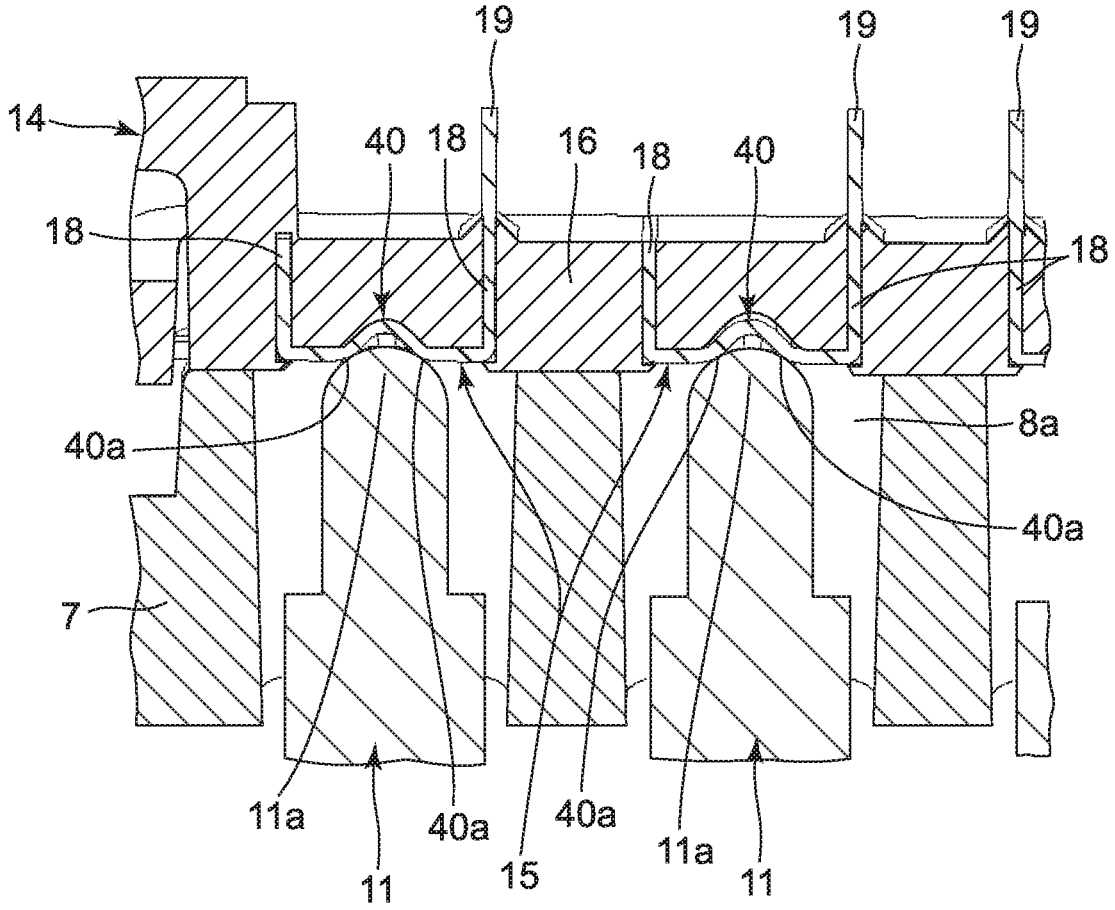
FIG. 20 is an enlarged cross-sectional view of the main part, showing a state where a contact pin is pressed against a recessed section of the terminal shown in FIGS. 19A and 19B.
Figure 21A:
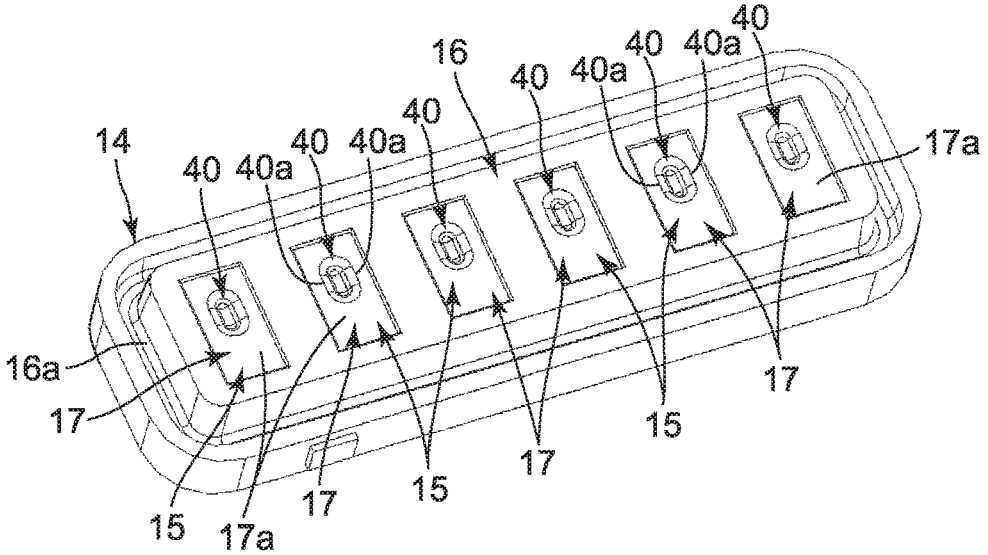
FIG. 21A is an enlarged perspective view of a terminal section of the portable terminal shown in FIG. 18 when viewed from a front surface side.
Figure 21B:
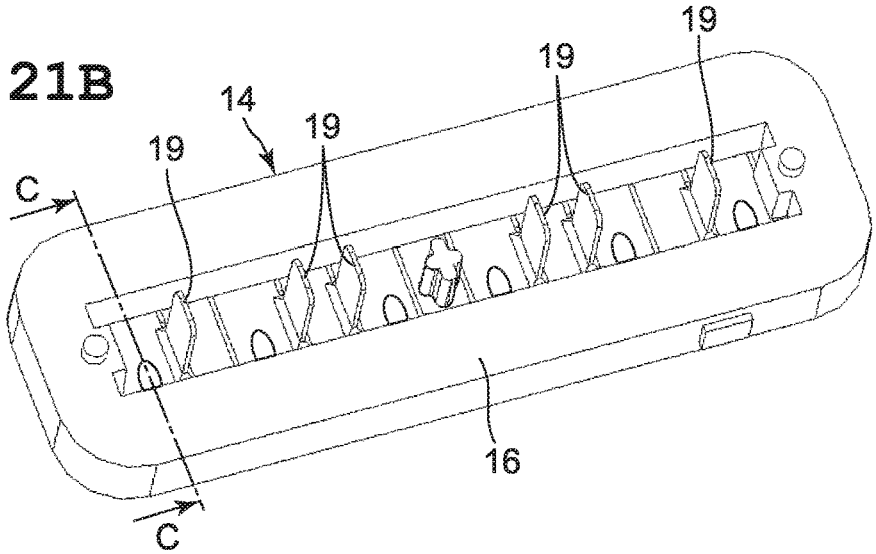
FIG. 21B is an enlarged perspective view of the terminal section of the portable terminal shown in FIG. 18 when viewed from a back surface side.
Figure 21C:
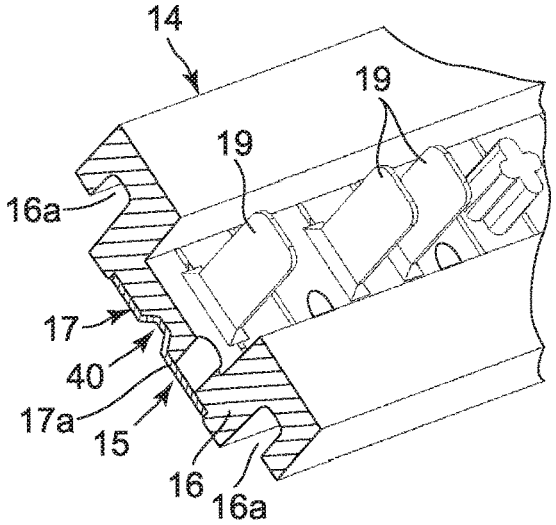
FIG. 21C is an enlarged perspective view of the main part taken along line C-C in FIG. 21B.

More specifically, in this contact target section 17, the recessed section 40 is provided with it being opened to the front surface side of the contact target section 17, in a vicinity of an end portion where the sliding of the tip portion 11*a* stops in the longitudinal direction which is the sliding direction where the tip portion 11*a* of the contact pin 11 of the connection section 10 is butted and slides, as shown in FIGS. 18 to 20. Therefore, in the contact target section 17, the flat surface 17*a* which is an area where the recessed section 40 is not provided is widely provided on a side where the tip portion 11*a* starts sliding (a lower portion side in FIG. 19A).

More specifically, the recessed section 40 is provided in a substantially mortar shape having an inverted mountain shape protruding from a front surface of the flat surface 17*a* of the contact target section 17 toward a back surface thereof, as shown in FIGS. 19A and 19B. The recessed section 40 is provided at a position to which the tip portion 11*a* of the contact pin 11 corresponds (an upper portion side in FIG. 19A) when the flat surface 17*a* of the contact target section 17 is pressed against the contact pin 11 and the leaf springs 12 are flexed most.

As a result, when the tip portion 11*a* of the contact pin 11 is butted against the flat surface 17*a* of the contact target section 17 and slides and the tip portion 11*a* reaches the vicinity of the end portion, a part of the tip portion 11*a* comes into the recessed section 40, as shown in FIGS. 19A, 19B, and 20. The tip portion 11*a* thereby becomes a state of coming in two-point contact with the edge 40*a* on the opening side of the recessed section 40. In addition, in this state where the two-point contact is achieved, the tip portion 11*a* further slides on the recessed section 40 of the contact target section 17, and then stops at a predetermined position in the recessed section 40. As a result, the recessed section 40 is structured to control the position of the tip portion 11*a* in a width direction orthogonal to the sliding direction of the tip portion 11*a*.

More specifically, in the recessed section 40, a length in the width direction orthogonal to the sliding direction of the tip portion 11*a* of the contact pin 11 is formed shorter than the diameter of the tip portion 11*a*, as shown in FIGS. 19A, 19B and 20. The edge 40*a* of the opening side of the recessed section 40 is formed in a substantially oval shape such that the length in the width direction orthogonal to the sliding direction of the tip portion 11*a* is shorter than the diameter of the tip portion 11*a* and the length in the sliding direction of the tip portion 11*a* is slightly longer than a length in the groove width direction.

As a result, as shown FIG. 20, the tip portion 11*a* of the contact pin 11 is structured such that, when sliding on the flat surface 17*a* of the contact target section 17 in accordance with the flexural deformation of the leaf springs 12 and reaching the recessed section 40, a part of the tip portion 11*a* comes into the recessed section 40, the position in the width direction orthogonal to the sliding direction of the tip portion 11*a* is thereby controlled and, in this state, the tip portion 11*a* comes in contact with the edge 40*a* on the opening side of the recessed section 40 at two points. In addition, the tip portion 11*a* is structured to further slide on the recessed section 40 of the contact target section 17 and then stop at a predetermined position in the recessed section 40 in this state where the two-point contact is achieved.

Next, a procedure for manufacturing the terminal section 14 of the portable terminal 1 in the third embodiment will be described with reference to FIGS. 22 to 23B. The third embodiment is different from the first embodiment in that the back surface of the flat surface 17*a* is pressed against the second mold 24 by the pressing section 35.

Figure 22:
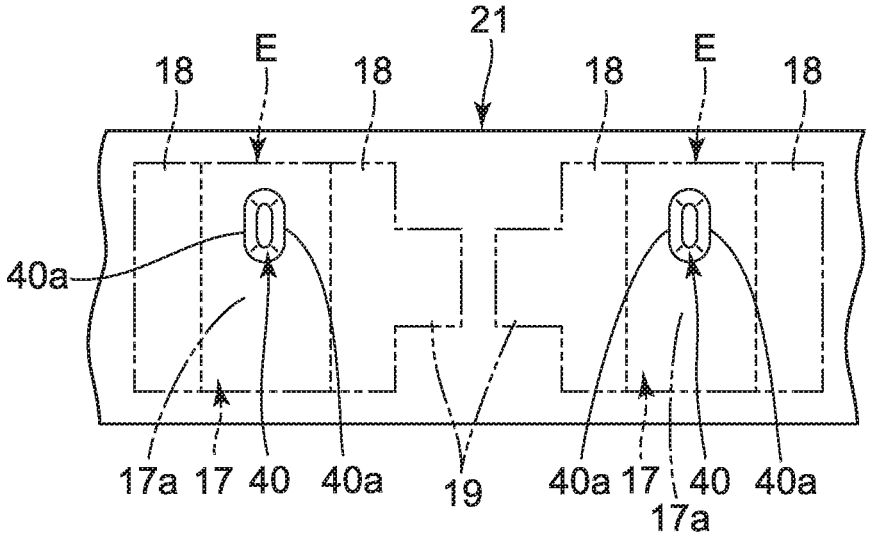
FIG. 22 is an enlarged plan view of the main part, showing a part of processes for manufacturing the terminal shown in FIG. 19B.

First, in the first step, the plurality of terminals 15 are fabricated at once, as shown in FIG. 22. That is, in a state where the plurality of recessed sections 40 are positioned at a predetermined position, that is, an upper side portion in the width direction orthogonal to the longitudinal direction of the metal plate 21 in FIG. 22, the plurality of terminals 15 are spaced apart from each other by a predetermined interval and formed at once by press working along the longitudinal direction of the metal plate 21.

In this state, for each of the plurality of recessed sections 40, each of the terminal areas E having a shape where the contact target section 17 of the terminal 15, the pair of reinforcing sections 18 on both sides thereof, and the connection piece 19 extending from one of the reinforcing sections 18 are developed (a part indicated by a two-dot chain line in FIG. 22) is secured along the longitudinal direction of the strip-shaped metal plate 21, and the plurality of terminal areas E are punched at once by punching processing, as shown in FIG. 22. As a result, the plurality of terminals 15 in a state where the contact target section 17, the pair of reinforcing sections 18, and the connection piece 19 are developed are simultaneously formed.

Here, the recessed section 40 is provided at a position deviated to the sliding direction of the tip portion 11*a* from the central portion of the contact target section 17 in the sliding area where the tip portion 11*a* of the contact pin 11 slides with respect to the front surface of the contact target section 17. Therefore, in the contact target section 17, the flat surface 17*a* which is an area where the recessed section 40 is not provided is widely provided on the side where the tip portion 11*a* starts sliding (a lower portion side in FIG. 22). In addition, the pair of the reinforcing sections 18 is folded toward the side opposite to the opening side of the recessed section 40 on both sides of the contact target section 17 of the terminal 15 (a part indicated by a dotted line in FIG. 22). As a result, the terminal 15 shown in FIG. 19B is formed.

Figure 23A:
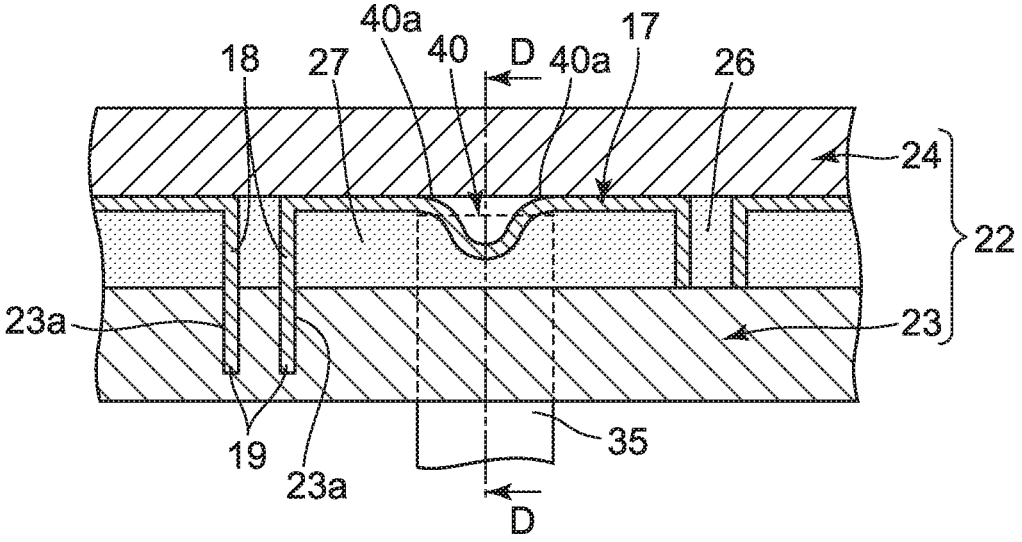
FIG. 23A is an enlarged cross-sectional view showing a main part of a mold for manufacturing the terminal section shown in FIGS. 21A to 21C.
Figure 23B:
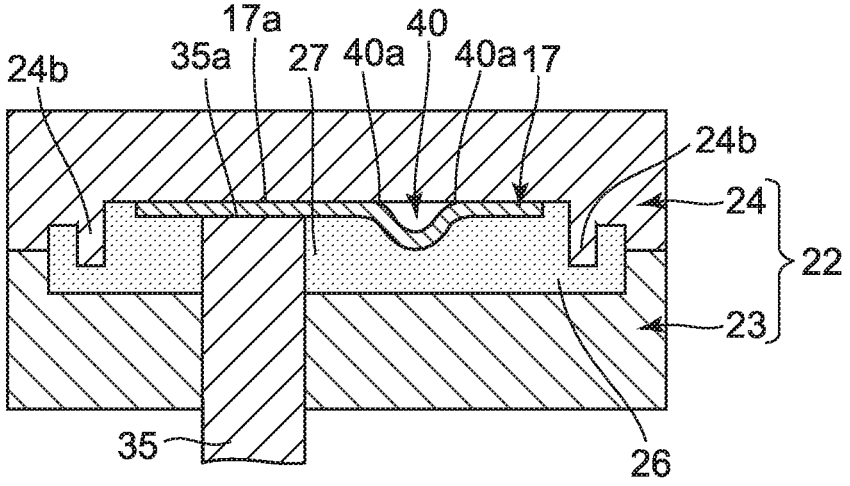
FIG. 23B is an enlarged cross-sectional view taken along line D-D in FIG. 23A.
Figure 24:
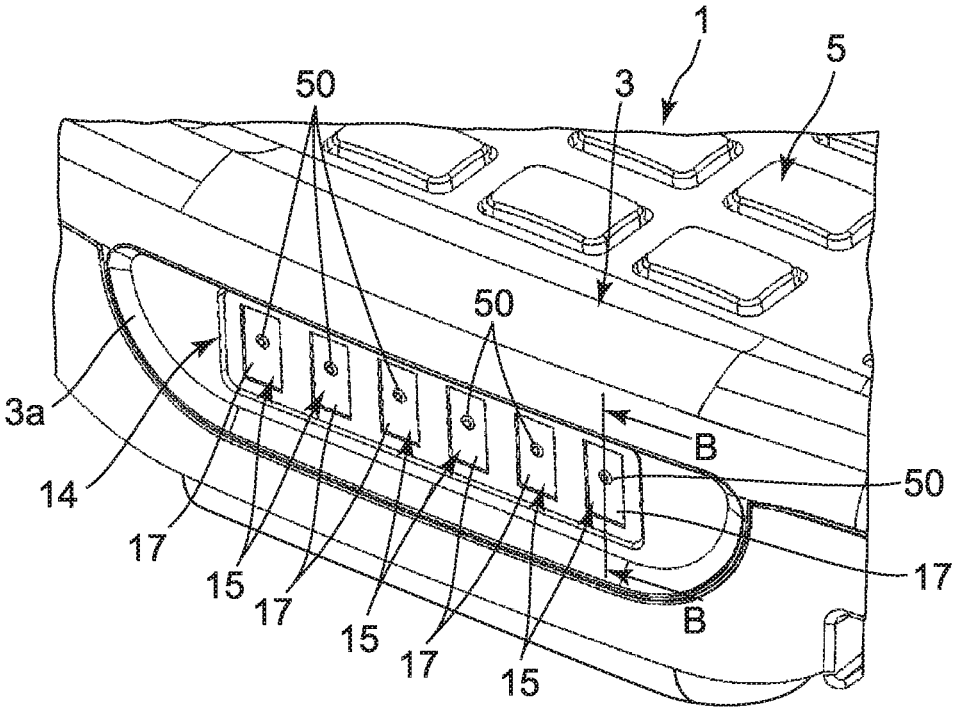
FIG. 24 is an enlarged perspective view of a main part, showing a lower end side of a portable terminal according to a fourth embodiment.

Next, in a second step, the plurality of terminals 15 are fixed in the molding die 22, as shown in FIGS. 23A and 23B. Here, the connection piece 19 protruding from one of the pair of the reinforcing sections 18 of the terminal 15 is inserted into the holding hole 23*a* of the first mold 23. As a result, the plurality of terminals 15 are held in the first mold 23.

In this state, the second mold 24 is superimposed on the first mold 23. Here, the frame-shaped protruding section 24*b* provided in the second mold 24 is arranged with it surrounding the outer periphery of the plurality of terminals 15.

As a result, the flat surface 17*a* which is the first surface of the contact target section 17 of the terminal 15 comes in contact with the inner surface of the second mold 24 except for the recessed section 40. In this state, a pressing section 35 slidably provided in the first mold 23 is pushed into a space section 26 surrounded by the first mold 23 and the second mold 24, and a back surface which is a second surface of the contact target section 17 of the terminal 15, that is, a back surface of the flat surface 17*a* of the terminal 15 is pressed toward the inner surface of the second mold 24 by the pressing section 35.

Here, a pressing surface 35*a* of the pressing section 35 presses the back surface of the flat surface 17*a* of the contact target section 17, which is located in the area where the recessed section 40 of the terminal 15 is not provided, toward the inner surface of the second mold 24. As a result, the flat surface 17*a* of the contact target section 17 comes in close contact with the inner surface of the second mold 24 except for the recessed section 40. In this state, the plurality of terminals 15 are fixed to the inside area between the first mold 23 and the second mold 24.

Then, in a third step, the resin 27 is injected into the space section 26 surrounded by the first mold 23 and the second mold 24, and the plurality of terminals 15 are molded to form the terminal section 14. That is, when the resin 27 is injected into the space section 26 inside between the first mold 23 and the second mold 24, the resin 27 covers the outer periphery of the pair of reinforcing sections 18 of the terminal 15 and, at the same time, is filled in the back surface side of the contact target section 17 excluding the pressing section 35.

As a result, the terminal 15 is molded by the resin 27 such that the flat surface 17*a* of the contact target section 17 of the terminal 15, the recessed section 40, and the connection piece 19 are exposed. Therefore, the plurality of terminals 15 are molded at once by the resin 27, and the terminal holder 16 is formed. Here, the mounting groove 16*a* is formed surrounding the plurality of terminals 15, around the front surface of the terminal holder 16 by the frame-shaped protruding section 24*b* of the second mold 24. As a result, the terminal section 14 is formed.

In this state, after the molded resin 27 is cured, the pressing section 35 is pulled out from the first mold 23, the first mold 23 and the second mold 24 are demolded, and the terminal section 14 which is a molded product is taken out from the molding die 22. As a result, the terminal section 14 in which the plurality of terminals 15 are embedded in the terminal holder 16 in a state of being arranged is manufactured. That is, in the terminal section 14, the flat surface 17*a* of the contact target section 17 of the terminal 15 and the recessed section 40 are provided to be exposed on the front surface side of the terminal holder 16, and the connection piece 19 is provided to protrude to the back surface side of the terminal holder 16.

When the terminal section 14 manufactured as described above is to be attached to the portable terminal 1, the edge portion of the opening section 3*a* provided at the lower end portion of the device case 3 is engaged with the mounting groove 16*a* provided around the front surface of the terminal holder 16, and each contact target section 17 of the plurality of terminals 15 is exposed to the outside from the opening section 3*a* of the device case 3. In this state, the terminal holder 16 is attached to the lower end portion of the device case 3. As a result, the terminal section 14 is attached to the portable terminal 1.

Next, an effect of the portable terminal 1 according to the third embodiment will be described. Note that descriptions for sections common to those of the first embodiment will be omitted.

When this portable terminal 1 is to be mounted on the cradle 2 and electrically connected thereto, the portable terminal 1 is inserted obliquely from above into the fitting recessed section 8 of the cradle 2, and the portable terminal 1 is pushed into the fitting recessed section 8 of the cradle 2. Then, the terminal section 14 provided at the lower end portion of the portable terminal 1 corresponds to the connection section 10 provided in the base 7 of the cradle 2, and the plurality of terminals 15 in the terminal section 14 of the portable terminal 1 are respectively pressed against the plurality of contact pins 11 of this connection section 10.

More specifically, the plurality of contact pins 11 of the connection section 10 protrude to the inside area of the fitting recessed section 8 through each opening section 8*a* provided at a bottom portion of the fitting recessed section 8 of the cradle 2. Therefore, when the portable terminal 1 is pushed into the fitting recessed section 8 of the cradle 2, the plurality of terminals 15 in the terminal section 14 of the portable terminal 1 are respectively pressed against each tip portion 11*a* of the plurality of contact pins 11.

Then, the plurality of leaf springs 12 of the connection section 10 are respectively flexed and deformed downward with the support bases 12*a* as the support point, and each tip portion 11*a* of each contact pin 11 slides with it being in elastic contact with the flat surface 17*a* of each contact target section 17 of each terminal 15 in accordance with the flexural deformation of each of the leaf springs 12. That is, when the tip portion 11*a* of the contact pin 11 is to be pressed against the flat surface 17*a* of the contact target section 17 of the terminal 15, first, the tip portion 11*a* of the contact pin 11 is pressed against a position away from the recessed section 40 in a sliding area in the flat surface 17*a* of the contact target section 17 by the spring force of the leaf springs 12.

In this state, when the terminal 15 in the terminal section 14 of the portable terminal 1 further pushes down the tip portion 11*a* of the contact pin 11 to further flex and deform the leaf springs 12 of the connection section 10, the tip portion 11*a* of contact pin 11 slides in a sliding area of the flat surface 17*a* with it being in elastic contact with the flat surface 17*a* of the contact target section 17 in accordance with the flexural deformation of the leaf springs 12, and the tip portion 11*a* of the contact pin 11 reaches the recessed section 40 which is a controlling section of the contact target section 17.

Then, a part of the tip portion 11*a* of the contact pin 11 enters the recessed section 40 of the contact target section 17 and butts against the edges 40*a* on both sides in the groove width direction of the recessed section 40 in a direction orthogonal to the sliding direction of the tip portion 11*a*. In this butted state, the tip portion 11*a* further slides along the recessed section 40 of the contact target section 17. As a result, the position of the tip portion 11*a* of the contact pin 11 in the groove width direction of the recessed section 40 is controlled.

More specifically, the tip portion 11*a* of the contact pin 11 is formed in a hemispherical shape or a curved shape, and the groove width of the recessed section 40 of the contact target section 17 is formed smaller than the diameter of the tip portion 11*a*. Therefore, when the part of the tip portion 11*a* of the contact pin 11 enters into the recessed section 40 of the contact target section 17 by the spring force of the leaf springs 12, the tip portion 11*a* is pressed against the edges 40*a* on both sides in the groove width direction of the recessed section 40, and therefore the position of the tip portion 11*a* in the groove width direction of the recessed section 40 is controlled.

As described above, when the tip portion 11*a* of the contact pin 11 is pressed against the edges 40*a* on both sides in the groove width direction of the recessed section 40 of the contact target section 17 and the position in the groove width direction is controlled, the contact pin 11 the tip portion 11*a* comes in contact with two points of the two edges 40*a* on both sides in the groove width direction of the recessed section 40. Therefore, the tip portion 11*a* of the contact pin 11 comes in contact with the contact target section 17 at two points. In addition, in this state, the tip portion 11*a* further slides along the recessed section 40 of the contact target section 17 and then stops at a predetermined position in the recessed section 40.

As a result, since the plurality of terminals 15 of the terminal section 14 and the plurality of contact pins 11 of the connection section 10 are conducted by the two-point contact, conductivity between the plurality of terminals 15 and the plurality of contact pins 11 becomes stable, the terminal section 14 of the portable terminal 1 and the connection section 10 of the cradle 2 are electrically connected to each other reliably, and reliability of connection performance is secured. Therefore, the portable terminal 1 is reliably and favorably charged by the cradle 2, and data exchange between the portable terminal 1 and the cradle 2 is reliably and favorably performed.

Further, after the tip portion 11*a* is butted against the flat surface 17*a* of the contact target section 17 and slides, a part of the tip portion 11*a* comes into the recessed section 40 to make two-point contact. In this state where the two-point contact is achieved, the tip portion 11*a* further slides along the recessed section 40. Therefore, a load on portions where they come in contact with each other is smaller than that in a case where the tip portion 11*a* slides on the recessed section 40 due to one-point contact. Consequently, plating scraping of the contact pin 11 and the contact target section 17 can be suppressed.

As described above, according to the terminal structure of this portable terminal 1 in the third embodiment, the flat surface 17*a* and the recessed section 40 that is the control section are provided in a front surface that is the first surface of the contact target section 17 with which the tip portion 11*a* of the contact pin 11 is brought into contact and, after the tip portion 11*a* is butted against the flat surface 17*a* and slides, the tip portion 11*a* is pressed against the recessed section 40 and the position thereof is controlled. According to this structure, reliability of connection performance can be secured by multi-point contact.

In addition, the recessed section 40 is provided at a position deviated to the sliding direction of the tip portion 11*a* from the central portion of the contact target section 17 in the sliding area of the tip portion 11*a* of the contact pin 11 with respect to the front surface which is the first surface of the contact target section 17. It is thereby possible to reliably and favorably press the tip portion 11*a* against the recessed section 40 after the tip portion 11*a* is butted against the flat surface 17*a* of the contact target section 17 and slides.

In addition, in the terminal structure of this portable terminal 1, the tip portion 11*a* of the contact pin 11 is formed in a hemispherical shape or a curved shape. When the tip portion 11*a* is pressed against the recessed section 40, the tip portion 11*a* comes in contact with, at two points, the front surface which is the first surface of the contact target section 17 in the recessed section 40, whereby the conductivity between the tip portion 11*a* of the contact pin 11 and the contact target section 17 is stabilized. Therefore, the reliability of connection performance between the contact pin 11 and the terminal 15 can be secured.

More specifically, in the terminal structure of this portable terminal 1, by a part of the tip portion 11*a* coming into the recessed section 40, the position of the tip portion 11*a* in a direction orthogonal to the sliding direction thereof can be controlled, and the tip portion 11*a* can be reliably brought into contact with the edge 40*a* of the recessed section 40. As a result, the conductivity between the tip portion 11*a* of the contact pin 11 and the contact target section 17 can be stabilized, and therefore the reliability of connection performance between the contact pin 11 and the terminal 15 can be secured.

In this case, in the recessed section 40, the length in the width direction orthogonal to the sliding direction of the tip portion 11*a* of the contact pin 11 is formed shorter than the diameter of the tip portion 11*a*, thereby allowing a part of the tip portion 11*a* to reliably and favorably be brought into contact with the edges 40*a* on both sides of the recessed section 40 at two points when the part of the tip portion 11*a* comes into the recessed section 40. As a result, the conductivity between the tip portion 11*a* of the contact pin 11 and the contact target section 17 can be stabilized.

In addition, in the terminal structure of this portable terminal 1, the contact target section 17 is arranged and provided in the terminal holder 16 in a state where the flat surface 17*a* which is the first surface of the contact target section 17 located on the opening side of the recessed section 40 is exposed. It is thereby possible to easily and favorably assemble the plurality of terminals 15 to the portable terminal 1. As a result, the plurality of terminals 15 can be connected to the plurality of contact pins 11 at once and, at the same time, a large amount of data can be efficiently exchanged between the portable terminal 1 and the cradle 2.

Also, a method for manufacturing the terminal section 14 includes a first step for fabricating a terminal 15 in which a flat surface 17*a* and a recessed section 40 are provided in a front surface of a contact target section 17 with which a tip portion 11*a* of a contact pin 11 comes in contact and on which the tip portion 11*a* slides, a second step for superimposing a second mold 24 on a first mold 23 holding the terminal 15 and, in a state where the second mold 24 is in contact with the flat surface 17*a* of the contact target section 17, pressing the flat surface 17*a* against the second mold 24 and fixing the flat surface 17*a* by a pressing section 35, and a third step for injecting a resin 27 into a space section 26 surrounded by the first and second molds 23, 24 and exposing the flat surface 17*a* and the recessed section 40 of the contact target section 17 to mold the terminal 15. It is thereby possible to efficiently and easily manufacture the terminal section 14.

More specifically, in the first step, when the terminal 15 is to be fabricated in which a flat surface 17*a* and a recessed section 40 are provided in the front surface which is the first surface of the contact target section 17 with which the tip portion 11*a* of the contact pin 11 is brought into contact, the plurality of recessed sections 40 can be spaced apart from each other by a predetermined interval along the longitudinal direction of the strip-shaped metal plate 21, and can be formed at once by press working at a predetermined position of the strip-shaped metal plate 21, that is, in a vicinity of an end portion of the tip portion 11*a* in the sliding area of the tip portion 11*a*.

In this state, for each of the plurality of recessed sections 40, each of the terminal areas E having a shape where the contact target section 17 of the terminal 15, the pair of reinforcing sections 18 on both sides thereof, and the connection piece 19 extending from one of the reinforcing sections 18 are developed can be secured along the longitudinal direction of the strip-shaped metal plate 21, and the plurality of terminal areas E can be punched at once by punching processing. Therefore, in this first step, the plurality of terminals 15 in which the contact target section 17, the pair of reinforcing sections 18, and the connection piece 19 are developed can be simultaneously formed, which makes productivity better.

In addition, the recessed section 40 is provided at a position deviated to the sliding direction of the tip portion 11*a* from the central portion of the contact target section 17 in the sliding area where the tip portion 11*a* of the contact pin 11 slides with respect to the front surface of the contact target section 17. Therefore, in the contact target section 17, the flat surface 17*a* which is an area where the recessed section 40 is not provided can be widely provided on the side where the tip portion 11*a* starts sliding. In addition, by the pair of reinforcing sections 18 being folded toward the side opposite to the opening side of the recessed section 40 on both sides of the contact target section 17 of the terminal 15 in this developed state (a part indicated by a dotted line in FIG. 22), the terminal 15 can be easily formed.

In addition, in the second step, the terminal 15 formed in the first step is held by the first mold 23, the second mold 24 is superimposed on this first mold 23 and, in a state where the second mold 24 is in contact with the flat surface 17*a* of the contact target section 17 excluding the recessed section 40 of the terminal 15, the flat surface 17*a* of the contact target section 17 is pressed against the second mold 24 by a pressing section 35. It is thereby possible to reliably and favorably fix the terminal 15 to the first mold 23 and the second mold 24. Here, by the connection piece 19 of the terminal 15 being held in the holding hole 23*a* of the first mold 23, the terminal 15 can be easily and favorably held in the first mold 23.

In addition, in this second step, the pressing section 35 is pressed against the back surface of the flat surface 17*a* of the contact target section 17 excluding the recessed section 40 of the contact target section 17, and thereby is not pressed against the recessed section 40. Accordingly, the back surface of the flat surface 17*a* of the contact target section 17 can be reliably pressed against the second mold 24, and therefore the flat surface 17*a* of the contact target section 17 of the terminal 15 can be reliably and favorably brought into close contact with the second mold 24.

More specifically, in the contact target section 17 of the terminal 15, the recessed section 40 is provided at a position deviated to the sliding direction of the tip portion 11*a* from the central portion of the contact target section 17 in the sliding area where the tip portion 11*a* of the contact pin 11 slides. Therefore, in the contact target section 17, the flat surface 17*a* which is an area where the recessed section 40 is not provided can be widely provided on the side where the tip portion 11*a* starts sliding.

Therefore, in the pressing section 35, the pressing surface 35*a* of a tip thereof can be formed to have a size corresponding to the area where the recessed section 40 is not provided. As a result, the pressing section 35 can be formed in a simple rod shape, and therefore the structure of the pressing section 35 can be simplified and the manufacturing cost can be reduced.

In addition, in this second step, by a plurality of holding holes 23*a* being provided which hold the connection piece of the terminal 15 in the first mold 23, the plurality of terminals 15 can be arranged and held in the first mold 23. Moreover, in this second step, by a plurality of pressing sections 35 being slidably provided in the first mold 23, the plurality of terminals 15 can be fixed to the inside area between the first mold 23 and the second mold 24 at once.

Further, in the third step, the resin 27 is injected into the space section 26 formed by being surrounded by the first mold 23 and the second mold 24 and, in a state where the front surface of the contact target section 17 of each terminal 15 is exposed, each terminal 15 is molded to form the terminal holder 16. It is thereby possible to reliably and favorably cover each terminal 15 with the resin 27.

More specifically, in this third step, when the resin 27 is injected into the space section 26 surrounded by the first mold 23 and the second mold 24, the outer periphery of the pair of reinforcing sections 18 of the terminal 15 can be covered with the resin 27 and, at the same time, the resin 27 can be poured and filled into the back surface side of the contact target section 17 excluding the pressing section 35.

Therefore, in this third step, in a state where the flat surface 17*a* of the contact target section 17, the recessed section 40, and the connection piece 19 of each terminal 15 are exposed, each terminal 15 can be reliably and favorably molded by the resin 27, and the plurality of terminals 15 fixed between the first mold 23 and the second mold 24 can be molded at once with the resin 27 to form the terminal holder 16, whereby the terminal section 14 in which the plurality of terminals 15 are arranged can be easily and efficiently formed.

In the third embodiment described above, the recessed section 40 is formed in a substantially oval shape such that the length in the width direction orthogonal to the sliding direction of the tip portion 11*a* of the contact pin 11 is shorter than the diameter of the tip portion 11*a*. However, the present invention is not limited thereto, and the shape of the recessed section 40 may be a polygon such as a triangle, a quadrangle, and a pentagon as long as the recessed section 40 is formed in a noncircular shape.

In that case, for example, the recessed section may be formed in a regular polygon such as a regular tetragon and a regular pentagon whose length in the width direction of the recessed section is shorter than the diameter of the tip portion 11*a*. That is, when a part of the tip portion 11*a* of the contact pin 11 enters the recessed section, if the recessed section is a regular tetragon, the tip portion 11*a* can be brought into contact with the edge of the recessed section at two to four points. If the recessed section is a regular pentagon, the tip portion 11*a* can be brought into contact with the edge of the recess at two to five points.

Accordingly, if the recessed section is a regular polygon, the tip portion 11*a* can be brought into contact with the edge of the recessed section at a plurality of points such as two or more points, whereby conductivity can be further secured and connection reliability can be further enhanced.

Also, in the present invention, the recess is not necessarily required to be formed in a polygonal shape. For example, the recessed section may be provided with it being recessed in a long groove shape along the sliding direction of the tip portion 11*a*. That is, the recessed section may be provided such that a bottom portion thereof forms a long valley bottom along the sliding direction of the tip portion 11*a* in a range avoiding a portion where the tip portion 11*a* butts against the front surface of the contact target section 17 and starts sliding, in the sliding area where the tip portion 11*a* of the contact pin 11 slides with respect to the front surface of the contact target section 17. Even in this case, an edge located on both sides of the valley bottom of the recessed section orthogonal to the sliding direction of the tip portion 11*a* may be formed such that a length in the groove width direction thereof, that is, an interval in the groove width direction thereof is shorter than the diameter of the tip portion 11*a*.

In the third embodiment described above, the pressing section 35 that presses and fixes the contact target section 17 of the terminal 15 held in the first mold 23 of the molding die 22 to the second mold 24 is formed in a rod shape. However, the present invention is not limited thereto. The pressing section 35 may be formed in a square rod whose tip surface is slightly smaller than the flat surface 17*a* of the contact target section 17, a plurality of abutting protrusion sections may be provided at a position avoiding the recessed section 40 in the tip surface of this square rod, and these abutting protrusion sections may be pressed against the back surface of the flat surface 17*a*.

Also, in the third embodiment and its modifications described above, the pressing section 35 that presses and fixes the contact target section 17 of the terminal 15 held in the first mold 23 of the molding die 22 to the second mold 24 is slidably provided in the first mold 23. However, the present invention is not limited thereto. For example, the pressing section 35 may be integrally provided in the first mold 23.

Further, in the third embodiment described above, the present invention is applied to the portable terminal 1. However, the present invention is not limited thereto, and may be applied to an electronic device such as a mobile phone.

While the third embodiment of the present invention has been described above, the present invention is not limited thereto and includes the invention described in the claims and the equivalent scope thereof.

Hereinafter, a fourth embodiment in which the present invention is applied to a portable terminal will be described with reference to FIG. 24 to FIG. 29B. Note that sections corresponding to those of the first embodiment in the drawings are provided with the same reference numerals for description.

In the fourth embodiment, a flat surface 17*a* and a protruding section 50 are provided instead of the groove section 20 in the contact target section 17 of the first embodiment. Hereinafter, in the fourth embodiment, sections different from those of the first embodiment will be mainly described.

As shown in FIGS. 24 to 27B, the contact target section 17 in the fourth embodiment is a section where a front surface that is a first surface thereof is brought into contact with the tip portion 11*a* of the contact pin 11 of the connection section 10 and where the tip portion 11*a* slides, and is formed in a quadrangular flat plate shape. This feature is the same as that of the first embodiment. However, in the contact target section 17 of the forth embodiment, the flat surface 17*a* and the protruding section 50 are provided in the front surface which is the first surface thereof.

Figure 25A:
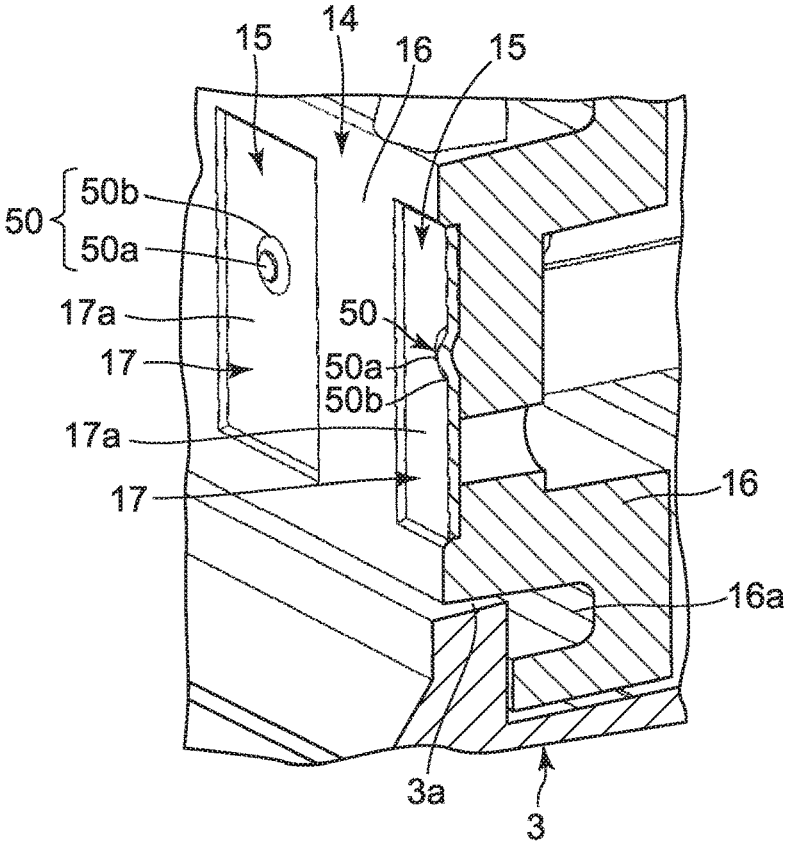
FIG. 25A is an enlarged perspective view showing a terminal section of the portable terminal shown in FIG. 24 with the main part being cut along line B-B.
Figure 25B:
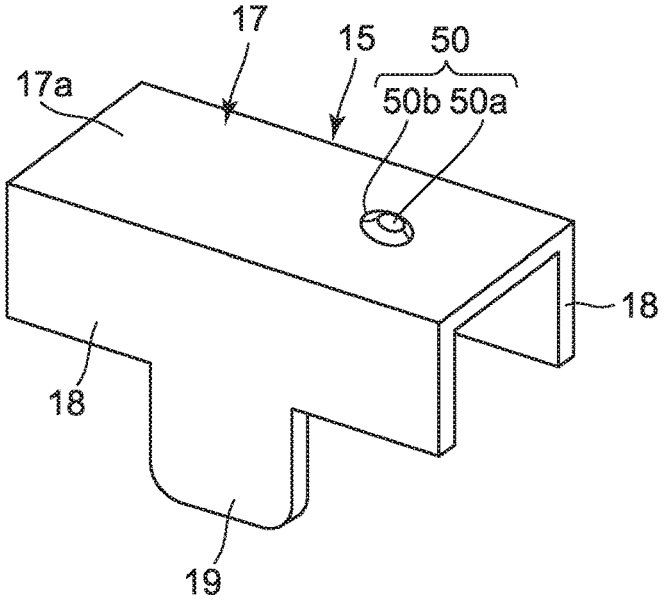
FIG. 25B is an enlarged perspective view showing a terminal of the terminal section of the portable terminal shown in FIG. 24.

As shown in FIGS. 25A and 25B, in this contact target section 17, the protruding section 50 which is a control section is provided at a predetermined position, that is, a position deviated from a central portion of the contact target section 17 in the sliding area where the tip portion 11*a* of the contact pin 11 slides with respect to the front surface of the contact target section 17.

Figure 26:
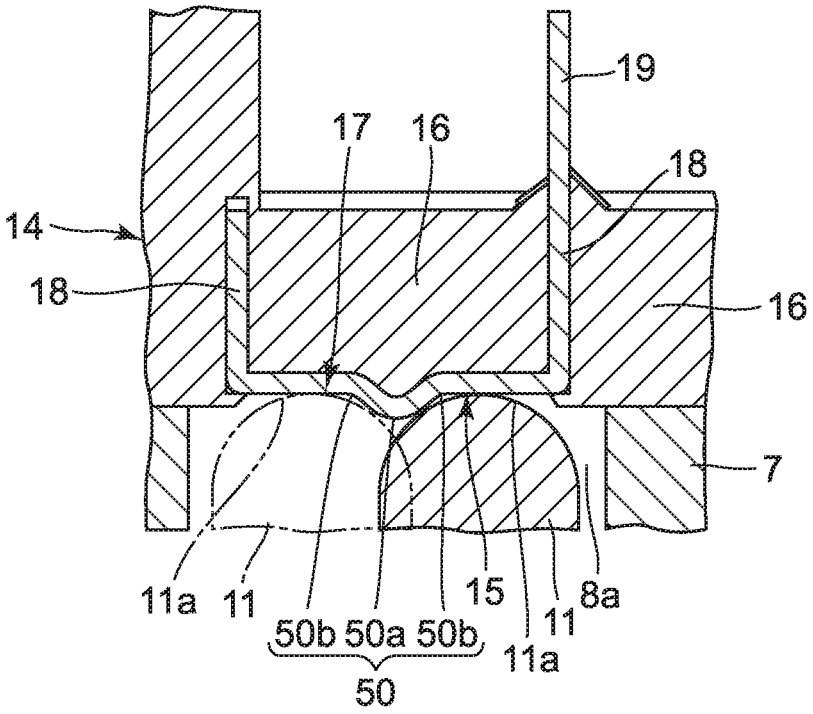
FIG. 26 is an enlarged cross-sectional view of the main part, showing a state where a contact pin is pressed against a protruding section of the terminal shown in FIGS. 25A and 25B.
Figure 27A:
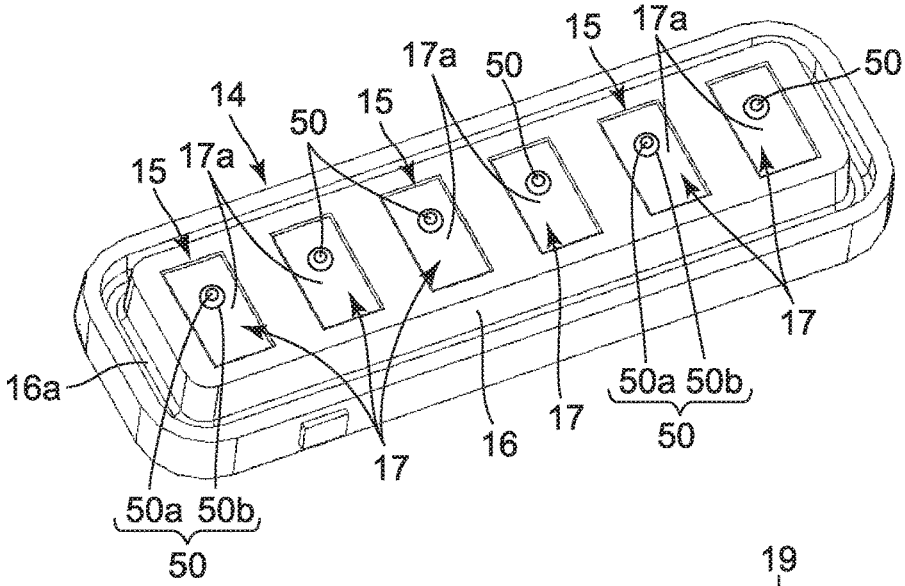
FIG. 27A is an enlarged perspective view of a terminal section of the portable terminal shown in FIG. 24 when viewed from a front surface side.
Figure 27B:
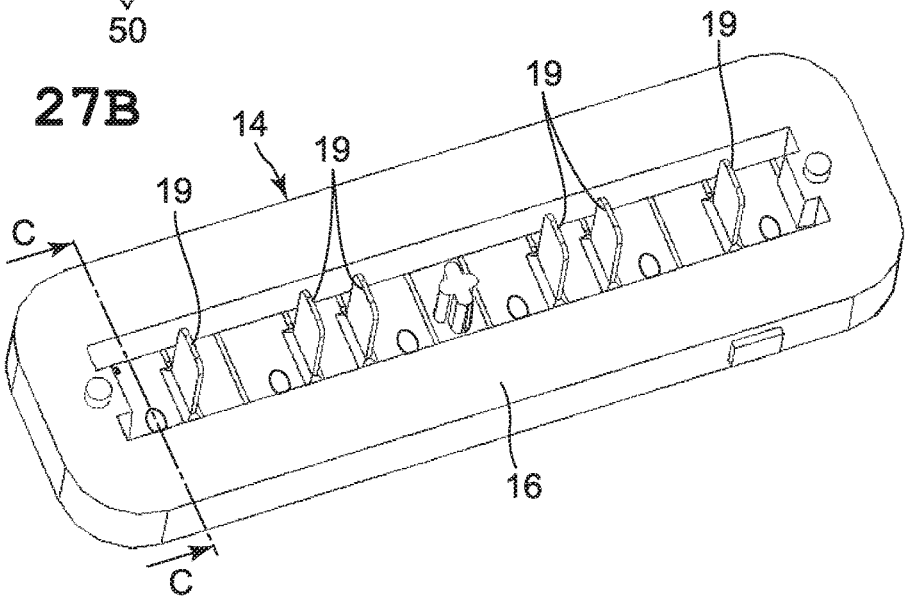
FIG. 27B is an enlarged perspective view of the terminal section of the portable terminal shown in FIG. 24 when viewed from a back surface side.
Figure 27C:
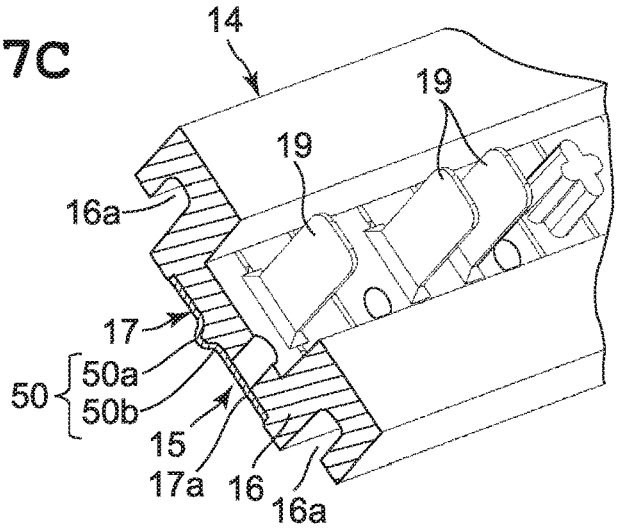
FIG. 27C is an enlarged perspective view of the main part taken along line C-C in FIG. 27B.

More specifically, in this contact target section 17, the protruding section 50 is provided such that it protrudes to the front surface side of the contact target section 17 in a substantially conical mountain shape, in a vicinity of an end portion where the sliding of the tip portion 11*a* stops in the longitudinal direction which is the sliding direction in which the tip portion 11*a* of the contact pin 11 of the connection section 10 is butted and slides, as shown in FIGS. 25A, 25B and 26. Therefore, in the contact target section 17, the flat surface 17*a* which is an area where the protruding section 50 is not provided is widely provided on a side where the tip portion 11*a* starts sliding (a lower portion side in FIG. 25A).

More specifically, as shown in FIGS. 25A and 25B, this protruding section 50 is provided at a position to which the tip portion 11*a* of the contact pin 11 corresponds (an upper portion side in FIG. 25A) when the flat surface 17*a* of the contact target section 17 is pressed against the tip portion 11*a* of the contact pin 11 and the leaf springs 12 are flexed most. As a result, the embodiment is structured such that, after the tip portion 11*a* of the contact pin 11 is butted against the contact target section 17 and slides on the flat surface 17*a*, the tip portion 11*a* is pressed against the protruding section 50, whereby the position of the tip portion 11*a* is controlled.

In the protruding section 50, the root 50*b* of its skirt area located around the top portion 50*a* is concentrically provided around the top portion 50*a* of the protruding section 50, as shown in FIGS. 25A, 25B, and 26. As a result, the tip portion 11*a* of the contact pin 11 is structured to come in two-point contact with the front surface which is the first surface of the contact target section 17 in the protruding section 50 when sliding in accordance with the flexural deformation of the leaf springs 12 and butting against the outer periphery of the protruding section 50. In this state where the two-point contact is achieved, the tip portion 11*a* further slides along the root 50*b* of the contact target section 17.

More specifically, in the protruding section 50, the skirt area extending from the top portion 50*a* to the root 50*b* of the outer periphery forms a recessed curved surface having a circular-arc or curved shape, and the curvature of the recessed curved surface is larger than that of the tip portion 11*a* of the contact pin 11, as shown in FIGS. 25A, 25B, and 26. That is, the curvature radius of the recessed curved surface of the skirt area is smaller than that of the tip portion 11*a* of the contact pin 11.

As a result, the contact pin 11 is structured to, when the tip portion 11*a* thereof slides on the flat surface 17*a* of the contact target section 17 and butts against the outer periphery of the protruding section 50, come in contact with two points which are a point in the skirt area located on the top portion 50*a* side and a point in the skirt area located on the root 50*b* side of the protruding section 50, and unpredictably proceed in this state toward a direction of one of root 50*b* portions on both sides of the skirt area located in a direction orthogonal to the sliding direction of the tip portion 11*a*, with the top portion 50*a* of the protruding section 50 as a boundary, as shown in FIG. 26.

More specifically, the tip portion 11*a* of the contact pin 11 is structured such that the curvature thereof is formed smaller than that of the recessed curved surface of the skirt area of the protruding section 50. Therefore, the tip portion 11*a* becomes unstable when it is butted against the protruding section 50. In this state, by being pressed by the spring force of the leaf springs 12 and sliding, the tip portion 11*a* unpredictably proceeds toward a direction of one of root 50*b* portions on both sides of the skirt area located in a direction orthogonal to the sliding direction of the tip portion 11*a* with the top portion 50*a* of the protruding section 50 as a boundary, as shown in FIG. 26.

In addition, the tip portion 11*a* of the contact pin 11 is structured to, when it is butted against the protruding section 50 of the contact target section 17 and slides on one side of the protruding section 50 located in a direction orthogonal to the sliding direction of the tip portion 11*a*, come in contact with two points which are a point in the skirt area located on the top portion 50*a* side and a point in the skirt area located on the root 50*b* side of the protruding section 50, and thereby come in contact with the contact target section 17 at two points, as shown in FIG. 26. In addition, the tip portion 11*a* is structured to further slide along the root 50*b* of the contact target section 17 and then stop at a predetermined position in this state where the two-point contact is achieved.

Next, a procedure for manufacturing the terminal section 14 of the portable terminal 1 in the fourth embodiment will be described with reference to FIG. 28 to FIG. 29B. The fourth embodiment is different from the first embodiment in that the back surface of the flat surface 17*a* is pressed against the second mold 24 by the pressing section 35. In addition, the second embodiment is different from the first embodiment in that the relief recessed section 24*a* is provided in the second mold 24 of the first embodiment.

Figure 28:
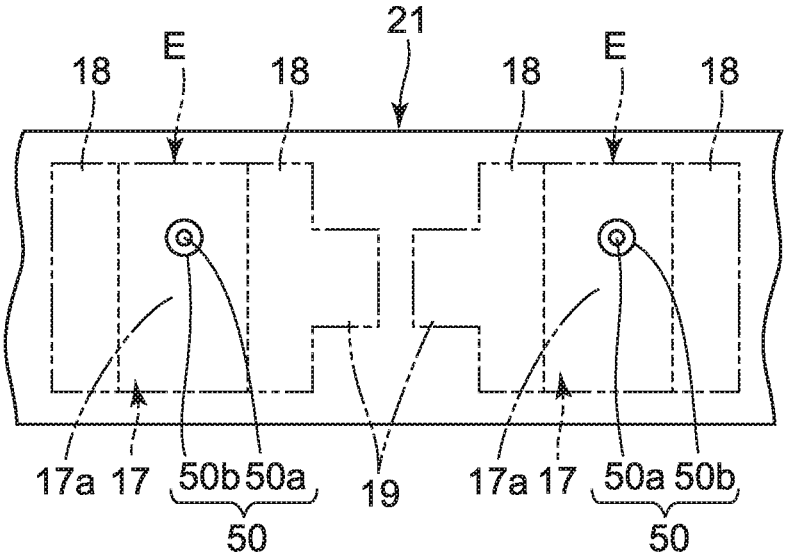
FIG. 28 is an enlarged plan view of the main part, showing a part of processes for manufacturing the terminal shown in FIG. 25B.

First, in a first step, the plurality of terminals 15 are fabricated at once, as shown in FIG. 28. That is, in a state where the plurality of protruding sections 50 which are control sections are positioned at a predetermined position, that is, a predetermined part on a side of an upper side portion in the width direction orthogonal to the longitudinal direction of the metal plate 21 in FIG. 28, the plurality of terminals 15 are spaced apart from each other by a predetermined interval and formed at once by press working along the longitudinal direction of the metal plate 21.

In this state, for each of the plurality of protruding sections 50, each of the terminal areas E having a shape where the contact target section 17 of the terminal 15, the pair of reinforcing sections 18 on both sides thereof, and the connection piece 19 extending from one of the reinforcing sections 18 are developed (a part indicated by a two-dot chain line in FIG. 28) is secured along the longitudinal direction of the strip-shaped metal plate 21, and the plurality of terminal areas E are punched at once by punching processing, as shown in FIG. 28. As a result, the plurality of terminals 15 in a state where the contact target section 17, the pair of reinforcing sections 18, and the connection piece 19 are developed are simultaneously formed.

Here, the protruding section 50 is provided at a position deviated to the central portion of the contact target section 17 in the sliding area of the tip portion 11*a* with respect to the front surface of the contact target section 17. Therefore, in the contact target section 17, the flat surface 17*a* which is an area where the protruding section 50 is not provided is widely provided on the side where the tip portion 11*a* starts sliding (a lower portion side in FIG. 28). In addition, the pair of the reinforcing sections 18 is folded toward the side opposite to the protruding direction of the protruding section 50 on both sides of the contact target section 17 of the terminal 15 in this developed state (a part indicated by a dotted line in FIG. 28). As a result, the terminal 15 shown in FIG. 25B is formed.

Figure 29A:
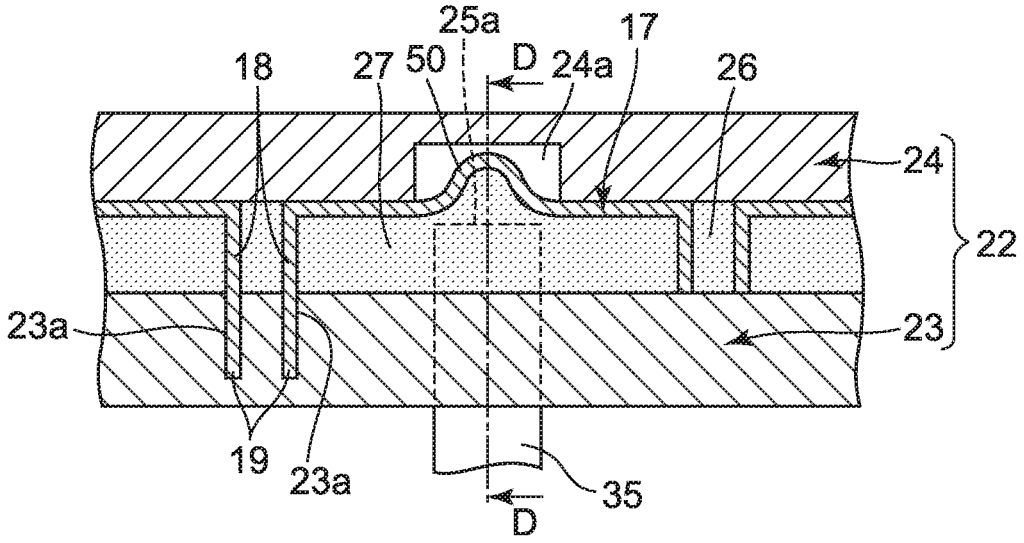
FIG. 29A is an enlarged cross-sectional view showing a main part of a mold for manufacturing the terminal section shown in FIG. 27.
Figure 29B:
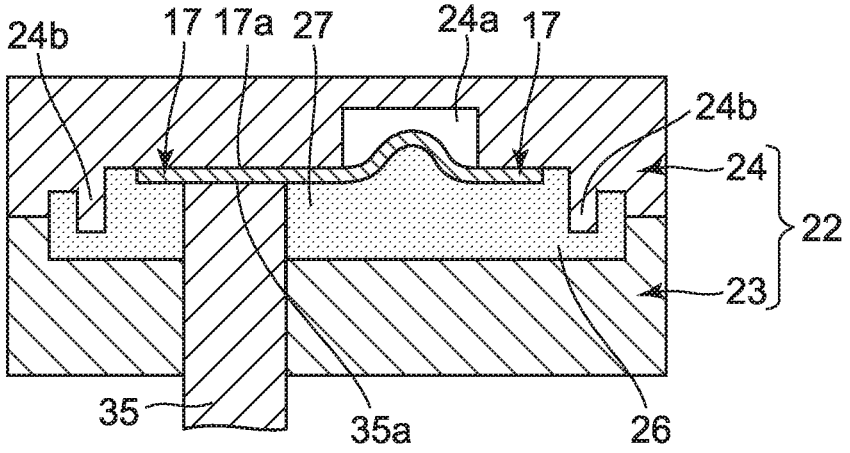
FIG. 29B is an enlarged cross-sectional view taken along line D-D in FIG. 29A.

Next, in a second step, the plurality of terminals 15 are fixed in the molding die 22. The molding die 22 is structured to be provided with a first mold 23 and a second mold 24 which superimpose with each other, as shown in FIGS. 29A and 29B. Therefore, first, the first mold 23 and the second mold 24 are demolded, and the plurality of terminals 15 are held in the demolded first mold 23. Here, the connection piece 19 protruding from one of the pair of reinforcing sections 18 of the terminal 15 is inserted into the holding hole 23*a* of the first mold 23. As a result, the plurality of terminals 15 are held in the first mold 23.

In this state, the second mold 24 is superimposed on the first mold 23. Here, the frame-shaped protruding section 24*b* provided in the second mold 24 is arranged in a state of surrounding an outer periphery of the plurality of terminals 15 and, at the same time, each protruding section 50 of the plurality of terminals 15 is respectively arranged in the plurality of relief recessed sections 24*a* provided in the second mold 24. As a result, the flat surface 17*a* which is the first surface of the contact target section 17 of the terminal 15 comes in contact with the inner surface of the second mold 24 in a manner to avoid the protruding section 50.

Here, the space section 26 surrounded by the first mold 23 and the second mold 24 is formed. In this state, the pressing section 35 slidably provided in the first mold 23 is pushed into the space section 26 surrounded by the first mold 23 and the second mold 24, and the back surface which is the second surface of the contact target section 17, that is, the back surface of the flat surface 17*a* of the terminal 15 is pressed toward the inner surface of the second mold 24 by the pressing section 35. In this case, the pressing section 35 is formed in a round-rod-like or square-rod-like rod shape.

More specifically, in this pressing section 35, an area of the pressing surface 35*a* at the tip thereof is formed smaller than an area of the flat surface 17*a* which is an area where the protruding section 50 in the contact target section 17 is not provided. Therefore, when the pressing section 35 is pushed into the space section 26 surrounded by the first mold 23 and the second mold 24, the pressing surface 35*a* presses, against the inner surface of the second mold 24, the flat surface 17*a* located in the area where the protruding section 50 is not provided in the contact target section 17. As a result, the plurality of terminals 15 are fixed to the inside area between the first mold 23 and the second mold 24.

Then, in a third step, the resin 27 is injected into the space section 26 surrounded by the first mold 23 and the second mold 24, and the terminals 15 are molded to form the terminal section 14. That is, when the resin 27 is injected into the space section 26 surrounded by the first mold 23 and the second mold 24, the resin 27 covers the outer periphery of the pair of reinforcing sections 18 of the terminal 15 and, at the same time, is filled in the back surface side of the contact target section 17 excluding the pressing section 35.

As a result, the terminal 15 is molded by the resin 27 such that the flat surface 17*a* of the contact target section 17 of the terminal 15, the protruding section 50, and the connection piece 19 are exposed. Therefore, the plurality of terminals 15 are molded at once by the resin 27, and the terminal holder 16 is formed. Here, the mounting groove 16*a* is formed surrounding the plurality of terminals 15, around the front surface of the terminal holder 16 by the frame-shaped protruding section 24*b* of the second mold 24. As a result, the terminal section 14 is formed.

In this state, after the molded resin 27 is cured, first, the pressing section 35 is pulled out from the first mold 23. Then, the first mold 23 and the second mold 24 are demolded, and the terminal section 14 which is a molded product is taken out from the molding die 22. As a result, the terminal section 14 in which the plurality of terminals 15 are embedded in the terminal holder 16 in a state of being arranged is manufactured. That is, in the terminal section 14, the flat surface 17*a* of the contact target section 17 of the terminal 15 and the protruding section 50 are provided to be exposed on the front surface side of the terminal holder 16, and the connection piece 19 is provided to protrude to the back surface side of the terminal holder 16.

When the terminal section 14 manufactured as described above is to be attached to the portable terminal 1, the edge portion of the opening section 3*a* provided at the lower end portion of the device case 3 is engaged with the mounting groove 16*a* provided around the front surface of the terminal holder 16, and each contact target section 17 of the plurality of terminals 15 is exposed to the outside from the opening section 3*a* of the device case 3. In this state, the terminal holder 16 is attached to the lower end portion of the device case 3. As a result, the terminal section 14 is attached to the portable terminal 1.

Next, an effect of the portable terminal 1 according to the fourth embodiment will be described. Note that descriptions for sections common to those of the first embodiment will be omitted.

When this portable terminal 1 is to be mounted on the cradle 2 and electrically connected thereto, the portable terminal 1 is inserted obliquely from above into the fitting recessed section 8 of the cradle 2, and the portable terminal 1 is pushed into the fitting recessed section 8 of the cradle 2. Then, the terminal section 14 provided at the lower end portion of the portable terminal 1 corresponds to the connection section 10 provided in the base 7 of the cradle 2, and the plurality of terminals 15 in the terminal section 14 of the portable terminal 1 are respectively pressed against the plurality of contact pins 11 of this connection section 10.

More specifically, the plurality of contact pins 11 of the connection section 10 protrude to the inside of the fitting recessed section 8 through each opening section 8*a* provided at a bottom portion of the fitting recessed section 8 of the cradle 2. Therefore, when the portable terminal 1 is pushed into the fitting recessed section 8 of the cradle 2, the plurality of terminals 15 in the terminal section 14 of the portable terminal 1 are respectively pressed against each tip portion 11*a* of the plurality of contact pins 11.

Then, the plurality of leaf springs 12 of the connection section 10 are respectively flexed and deformed downward with the support bases 12*a* as the support point, and each tip portion 11*a* of each contact pin 11 slides with it being in elastic contact with the flat surface 17*a* of each contact target section 17 of each terminal 15 in accordance with the flexural deformation of each of the leaf springs 12. That is, when the tip portion 11*a* of the contact pin 11 is pressed against the flat surface 17*a* of the contact target section 17, first, the tip portion 11*a* of the contact pin 11 is pressed against a position away from the protruding section 50 in a sliding area in the flat surface 17*a* of the contact target section 17 by the spring force of the leaf springs 12.

In this state, when the terminal 15 in the terminal section 14 of the portable terminal 1 further pushes down the tip portion 11*a* of the contact pin 11 so as to further flex and deform the leaf springs 12 of the connection section 10, the tip portion 11*a* of contact pin 11 slides in a sliding area of the flat surface 17*a* with it being in elastic contact with the flat surface 17*a* of the contact target section 17 in accordance with the flexural deformation of the leaf springs 12, and the tip portion 11*a* of the contact pin 11 butts against the protruding section 50 of the contact target section 17. In this butted state, the tip portion 11*a* further slides along the root 50*b* of the contact target section 17.

Here, the tip portion 11*a* of the contact pin 11 is formed in a hemispherical shape or a curved shape, and the protruding section 50 of the contact target section 17 is concentrically provided in a mountain shape around the top portion 50*a*. Therefore, when sliding on the flat surface 17*a* of the contact target section 17 in accordance with the flexural deformation of the leaf springs 12 and butting against the outer periphery of the protruding section 50, the tip portion 11*a* of the contact pin 11 comes in contact with, at two points, the front surface of the contact target section 17 located on the outer periphery of the protruding section 50. Then, in this state where the two-point contact is achieved, the tip portion 11*a* further slides along the root 50*b* of the contact target section 17 and then stops at a predetermined position.

More specifically, in the protruding section 50, the skirt area extending from the top portion 50*a* to the roots 50*b* of the outer periphery forms a recessed curved surface having a circular-arc or curved shape, and the curvature of the recessed curved surface is larger than that of the tip portion 11*a* of the contact pin 11. Therefore, the tip portion 11*a* of the contact pin 11 is pressed against the protruding section 50 with it being in contact with two points which are a point located in the top portion 50*a* side and a point located in the root 50*b* side of the protruding section 50.

In this state, when the tip portion 11*a* of the contact pin 11 is further pressed against the protruding section 50 of the contact target section 17, since the tip portion 11*a* of the contact pin 11 is in an unstable state, the tip portion 11*a* unpredictably proceeds toward a direction of one of root 50*b* portions on both sides of the skirt area located in a direction orthogonal to the sliding direction of the tip portion 11*a*, with the top portion 50*a* of the protruding section 50 as a boundary.

As described above, when the tip portion 11*a* of the contact pin 11 moves to one side of the protruding section 50, the leaf spring 12 is twisted and the tip portion 11*a* comes in contact with two points which are a point in the skirt area located on the top portion 50*a* side and a point in the skirt area located on the root 50*b* side of the protruding section 50. More specifically, in the protruding section 50, the skirt area extending from the top portion 50*a* to the roots 50*b* of the outer periphery forms a recessed curved surface having a circular-arc or curved shape, and the curvature of the recessed curved surface is larger than that of the tip portion 11*a* of the contact pin 11.

Therefore, even when the tip portion 11*a* of the contact pin 11 moves to one side of the protruding section 50 of the contact target section 17, the tip portion 11*a* can be pressed against the protruding section 50 by the twisting force of the leaf springs 12 with it being in contact with the two points which are a point in the skirt area located on the top portion 50*a* side and a point in the skirt area located on the root 50*b* side of the protruding section 50. As a result, the tip portion 11*a* of the contact pin 11 comes in contact with the contact target section 17 at two points and, in this state, the position of the tip portion 11*a* is controlled by being pressed against one side of the protruding section 50.

In this state, since the plurality of terminals 15 of the terminal section 14 and the plurality of contact pins 11 of the connection section 10 are conducted by the two-point contact, conductivity between the plurality of terminals 15 and the plurality of contact pins 11 becomes stable, the terminal section 14 of the portable terminal 1 and the connection section 10 of the cradle 2 are electrically connected to each other reliably, and reliability of connection performance is secured. Therefore, the portable terminal 1 is reliably and favorably charged by the cradle 2, and data exchange between the portable terminal 1 and the cradle 2 is reliably and favorably performed.

As described above, according to the terminal structure of this portable terminal 1, the flat surface 17*a* and the protruding section 50 are provided in a front surface which is the first surface of the contact target section 17 with which the tip portion 11*a* of the contact pin 11 is brought into contact. After the tip portion 11*a* of the contact pin 11 is butted against the flat surface 17*a* of the contact target section 17 and slides, the tip portion 11*a* is pressed against the outer periphery of the protruding section 50, whereby the tip portion 11*a* comes in contact with a plurality of points of the contact target section 17. As a result, reliability of connection performance can be secured.

In this embodiment, the protruding section 50 is provided at a position deviated to the sliding direction of the tip portion 11*a* from the central portion of the contact target section 17 in the sliding area of the tip portion 11*a* with respect to the front surface which is the first surface of the contact target section 17. It is thereby possible to reliably and favorably press the tip portion 11*a* against the outer periphery of the protruding section 50 after the tip portion 11*a* is butted against the flat surface 17*a* of the contact target section 17 and slides.

In addition, in the terminal structure of this portable terminal 1, the tip portion 11*a* of the contact pin 11 is formed into a hemispherical shape or a curved shape and, when pressed against the outer periphery of the protruding section 50, comes in two-point contact with the front surface which is the first surface of the contact target section 17, whereby conductivity between the tip portion 11*a* of the contact pin 11 and the contact target section 17 is stabilized. As a result, the reliability of connection performance between the contact pin 11 and the terminal 15 can be secured.

Further, after being butted against the flat surface 17*a* of the contact target section 17 and sliding, the tip portion 11*a* butts against the outer periphery of the protruding section 50 to achieve two-point contact. In this state where the two-point contact is achieved, the tip portion 11*a* further slides along the root 50*b*. Therefore, a load on portions where they come in contact with each other is smaller than that in a case where the tip portion 11*a* slides due to one-point contact. Consequently, plating scraping of the contact pin 11 and the contact target section 17 can be suppressed.

More specifically, in the terminal structure of this portable terminal 1, when the tip portion 11*a* of the contact pin 11 slides on the flat surface 17*a* of the contact target section 17 with it being pressed against the flat surface 17*a*, and butts against the protruding section 50, this tip portion 11*a* becomes unstable in a direction orthogonal to the sliding direction thereof. Therefore, the tip portion 11*a* can be caused to proceed toward a direction of one of both sides of the protruding section 50 with the top portion 50*a* of the protruding section 50 as a boundary. As a result, the tip portion 11*a* can be reliably moved to one side of the protruding section 50 to control the position.

In addition, in the protruding section 50, the skirt area extending from the top portion 50*a* to the root 50*b* of the outer periphery forms a recessed curved surface having a circular-arc or curved shape, and the curvature of the recessed curved surface is larger than that of the tip portion 11*a* of the contact pin 11, whereby the tip portion 11*a* reliably comes in contact with the front surface of the contact target section 17 located on the outer periphery of the protruding section 50 at two points when moving to one side of the protruding section 50, and the position of the tip portion 11*a* with respect to the contact target section 17 can be reliably and favorably controlled in this state.

More specifically, in the protruding section 50, the skirt area extending from the top portion 50*a* to the root 50*b* of the outer periphery forms a recessed curved surface having a circular-arc or curved shape, and the curvature of the recessed curved surface is larger than that of the tip portion 11*a* of the contact pin 11, whereby the tip portion 11*a* comes in contact with two points which are a point in the skirt area located on the top portion 50*a* side and a point in the skirt area located on the root 50*b* side of the protruding section 50. Therefore, the conductivity between the tip portion 11*a* of the contact pin 11 and the contact target section 17 can be further stabilized, and thus the reliability of the connection performance between the contact pin 11 and the terminal 15 can be reliably enhanced.

Further, in the terminal structure of this portable terminal 1, the contact target section 17 is arranged and provided in the terminal holder 16 in a state where the front surface which is the first surface of the contact target section 17 from which the protruding section 50 protrudes is exposed. It is thereby possible to easily and favorably assemble the plurality of terminals 15 to the portable terminal 1 in a state where the flat surface 17*a* and the protruding section 50 are exposed. As a result, the plurality of contact target sections 17 can be connected to the plurality of contact pins 11 at once. Therefore, a large amount of data can be efficiently exchanged between the portable terminal 1 and the cradle 2.

Also, a method for manufacturing the terminal section 14 includes a first step for fabricating a terminal 15 in which a flat surface 17*a* and a protruding section 50 are provided in a front surface which is a first surface of a contact target section 17 and where a tip portion 11*a* of a contact pin 11 comes in contact and the tip portion 11*a* slides, a second step for superimposing a second mold 24 on a first mold 23 holding the terminal 15 and, in a state where the second mold 24 is in contact with the flat surface 17*a* so as to avoid at least the protruding section 50, pressing the flat surface 17*a* against the second mold 24 and fixing the flat surface 17*a* by a pressing section 35, and a third step for injecting a resin 27 into a space section 26 surrounded by the first and second molds 23 and 24 and thereby molding the terminal 15 in a manner to expose at least part of the flat surface 17*a* and the protruding section 50 of the contact target section 17. It is thereby possible to efficiently and easily manufacture the terminal section 14.

More specifically, in the first step, when the terminal 15 is to be fabricated in which the protruding section 50 is provided at a predetermined position in the contact target section 17 with which the tip portion 11*a* of the contact pin 11 is brought into contact, a plurality of protruding sections 50 can be spaced apart from each other by a predetermined interval along the longitudinal direction of the strip-shaped metal plate 21 and can be formed at once by press working in a state of being located at a position in a vicinity of an end portion in the sliding direction of the tip portion 11*a*.

In this state, for each of the plurality of protruding sections 50, each of the terminal areas E having a shape where the contact target section 17 of the terminal 15, the pair of reinforcing sections 18 on both sides thereof, and the connection piece 19 extending from one of the reinforcing sections 18 are developed can be secured along the longitudinal direction of the strip-shaped metal plate 21, and the plurality of terminal areas E can be punched at once by punching processing. Therefore, in this first step, the plurality of terminals 15 in which the contact target section 17, the pair of reinforcing sections 18, and the connection piece 19 are developed can be simultaneously formed.

In addition, the protruding section 50 is provided at a position deviated from a central portion of the contact target section 17 in the sliding area where the tip portion 11*a* slides with respect to the front surface which is the first surface of the contact target section 17. Therefore, in the contact target section 17, the flat surface 17*a* which is an area where the protruding section 50 is not provided can be widely provided on a side where the tip portion 11*a* starts sliding. In addition, by the pair of reinforcing sections 18 being folded toward the side opposite to the protruding direction of the protruding section 50 on both sides of the contact target section 17 of the terminal 15 in this developed state (a part indicated by a dotted line in FIG. 28), the terminal 15 can be easily formed.

In addition, in the second step, the terminal 15 formed in the first step is held by the first mold 23, the second mold 24 is superimposed on this first mold 23 and, in a state where the second mold 24 is in contact with the flat surface 17*a* of the contact target section 17 in a manner to avoid the protruding section 50 of the terminal 15, the flat surface 17*a* of the contact target section 17 is pressed against the second mold 24 by a pressing section 35. As a result, the terminal 15 can be reliably and favorably fixed to the first mold 23 and the second mold 24.

In addition, in the second step, by the connection piece 19 of the terminal 15 being held in the holding hole 23*a* of the first mold 23, the terminal 15 can be easily and favorably held in the first mold 23. In addition, in this second step, by the protruding section 50 of the terminal 15 being arranged in the relief recess section 24*a* provided in the second mold, the second mold 24 can be brought into close contact with the flat surface 17*a* of the contact target section 17 of the terminal 15 without crushing the protruding section 50.

Also, in this second step, the pressing section 35 is pressed against the back surface of the flat surface 17*a* of the contact target section 17 excluding the protruding section 50 of the terminal 15, and thereby is not pressed against the protruding section 50. In addition, the back surface of the flat surface 17*a* of the contact target section 17 can be reliably pressed against the second mold 24 by the pressing section 25. Therefore, the flat surface 17*a* of the contact target section 17 of the terminal 15 can be reliably and favorably brought into close contact with the second mold 24.

In this embodiment, the pressing section 35 is formed in a round-rod-like or square-rod-like rod shape, and the area of the pressing surface 35*a* of the tip thereof is formed to be smaller than the area of the flat surface 17*a* which is an area where the protruding section 50 in the contact target section 17 is not provided. This pressing section 35 is slidably provided in the first mold 23 along the demolding direction. As a result, the pressing section 35 can be slid and easily and reliably pushed into the space section 26 between the first mold 23 and the second mold 24.

Therefore, when the pressing section 35 is pushed into the space section 26 surrounded by the first mold 23 and the second mold 24, the pressing surface 35*a* reliably presses, against the inner surface of the second mold 24, the flat surface 17*a* located in the area where the protruding section 50 is not provided in the contact target section 17. As a result, the plurality of terminals 15 can be reliably and firmly fixed to the inside area between the first mold 23 and the second mold 24 by the pressing section 35, respectively.

More specifically, in the contact target section 17 of the terminal 15, the protruding section 50 is provided at a position deviated to the sliding direction of the tip portion 11*a* from the central portion of the contact target section 17 in the sliding area where the tip portion 11*a* of the contact pin 11 slides. Therefore, in the contact target section 17, the flat surface 17*a* which is an area where the protruding section 50 is not provided can be widely provided on the side where the tip portion 11*a* starts sliding.

Therefore, in the pressing section 35, the pressing surface 35*a* of a tip thereof can be formed to have a size corresponding to the area where the protruding section 50 is not provided. As a result, the pressing section 35 can be formed in a simple rod shape, and therefore the structure of the pressing section 35 can be simplified, and the manufacturing cost can be reduced.

In addition, in this second step, by a plurality of holding holes 23*a* that hold the connection piece of the terminal 15 being provided in the first mold 23 and a plurality of relief recessed sections 24*a* where the protruding section 50 of the terminal 15 is arranged being provided in the second mold, the plurality of terminals 15 can be arranged and held in the first mold 23. Moreover, in this second step, by a plurality of pressing sections 35 being slidably provided in the first mold 23, the plurality of terminals 15 can be fixed to the inside area between the first mold 23 and the second mold 24 at once.

Further, in the third step, the resin 27 is injected into the space section 26 formed by being surrounded by the first mold 23 and the second mold 24 and, in a state where the flat surface 17*a* of the contact target section 17 and the protruding sections 50 of each terminal 15 are exposed, each terminal 15 is molded to form the terminal holder 16. It is thereby possible to reliably and favorably cover each terminal 15 with the resin 27.

More specifically, in this third step, when the resin 27 is injected into the space section 26 surrounded by the first mold 23 and the second mold 24, the outer periphery of the pair of reinforcing sections 18 of the terminal 15 can be covered with the resin 27 and, at the same time, the resin 27 can be poured and filled into the back surface side of the contact target section 17 excluding the pressing section 35.

Therefore, in this third step, in a state where the flat surface 17*a* of the contact target section 17, the protruding section 50, and the connection piece 19 of each terminal 15 are exposed, each terminal 15 can be reliably and favorably molded by the resin 27 and, at the same time, the plurality of terminals 15 fixed between the first mold 23 and the second mold 24 can be molded at once with the resin 27 so as to form the terminal holder 16. Therefore, the terminal section 14 in which the plurality of terminals 15 are arranged can be easily and efficiently formed.

In addition, in the fourth embodiment described above, the protruding section 50 on the front surface which is the first surface of the contact target section 17 of the terminal 15 is provided protruding in a substantially conical mountain shape, in a vicinity of an end portion where the tip portion 11*a* of the contact pin 11 is butted against the front surface of the contact target section 17 and slides. However, the present invention is not limited thereto, and the protruding section may be provided protruding in a long mountain shape along the sliding direction of the tip portion 11*a*.

More specifically, this protruding section may be provided such that a top portion thereof forms a long ridge along the sliding direction of the tip portion 11*a* in a range avoiding a portion where the tip portion 11*a* butts against the front surface of the contact target section 17 and starts sliding, in the sliding area where the tip portion 11*a* of the contact pin 11 slides with respect to the front surface of the contact target section 17. Even in this case, a skirt area located on both sides of the ridge of the protruding section orthogonal to the sliding direction of the tip portion 11*a* may be formed such that a curvature of the recessed curved surface thereof is larger than that of the tip portion 11*a*.

In addition, in the fourth embodiment described above, the pressing section 35 that presses and fixes the contact target section 17 of the terminal 15 held in the first mold 23 of the molding die 22 to the second mold 24 is formed in a simple rod shape. However, the present invention is not limited thereto. The pressing section 35 may be formed in a square rod whose tip surface is slightly smaller than the flat surface 17*a* of the contact target section 17, a plurality of abutting protrusion sections may be provided at a position avoiding the protruding section 50 in the tip surface of this square rod, and these abutting protrusion sections may be pressed against the back surface of the flat surface 17*a*.

In the fourth embodiment and its modified example described above, the pressing section 35 that presses and fixes the contact target section 17 of the terminal 15 held in the first mold 23 of the molding die 22 to the second mold 24 is slidably provided in the first mold 23. However, the present invention is not limited thereto. For example, the pressing section 35 may be integrally provided in the first mold 23.

Further, in the fourth embodiment described above, the present invention is applied to the portable terminal 1. However, the present invention is not limited thereto, and may be applied to an electronic device such as a mobile phone.

While the present invention has been described with reference to the preferred embodiments, it is intended that the invention be not limited by any of the details of the description therein but includes all the embodiments which fall within the scope of the appended claims.

What is claimed is:

1. A terminal structure comprising:

a contact target section with which a tip portion of a contact pin comes in contact; and a protruding section extending in a predetermined direction, wherein the protruding section is provided in the contact target section, wherein the protruding section is arranged such that the tip portion slides on one side of the protruding section along the protruding section by a pressing force occurred when the tip portion is butted against the contact target section so as to come in contact with the contact target section, wherein the protruding section is arranged such that the tip portion is butted against a top portion of the protruding section before sliding on the one side of the protruding section along the protruding section, when the tip portion is butted against the contact target section, wherein the protruding section is provided such that roots of the protruding section on both sides thereof extend in parallel to a predetermined direction, and wherein the protruding section is arranged such that the tip portion unpredictably proceeds toward a direction of one of the roots after being butted against the top portion of the protruding section.

2. A portable terminal comprising the terminal structure according to claim 1.

3. The terminal structure according to claim 1, wherein the tip portion is formed in a hemispherical shape or a curved shape, and comes in two-point contact with the contact target section on the one side of the protruding section.

4. A portable terminal comprising the terminal structure according to claim 3.

5. The terminal structure according to claim 1, wherein skirt areas of the protruding section positioned on said both sides and extending from the top portion to the roots on said both sides form a recessed curved surface having a circular-arc or curved shape, and wherein a curvature of the recessed curved surface is larger than a curvature of the tip portion.

6. A portable terminal comprising the terminal structure according to claim 5.

7. The terminal structure according to claim 3, wherein skirt areas of the protruding section positioned on said both sides and extending from the top portion to the roots on said both sides form a recessed curved surface having a circular-arc or curved shape, and wherein a curvature of the recessed curved surface is larger than a curvature of the tip portion.

8. A portable terminal comprising the terminal structure according to claim 7.

9. The terminal structure according to claim 1, wherein the contact target section is arranged and provided in a resin holder with a first surface of the contact target section from which the protruding section protrudes, and the protruding section being exposed.

10. A portable terminal comprising the terminal structure according to claim 9.

11. The terminal structure according to claim 3, wherein the contact target section is arranged and provided in a resin holder with a first surface of the contact target section from which the protruding section protrudes, and the protruding section being exposed.

12. A portable terminal comprising the terminal structure according to claim 11.

13. The terminal structure according to claim 5, wherein the contact target section is arranged and provided in a resin holder with a first surface of the contact target section from which the protruding section protrudes, and the protruding section being exposed.

14. A portable terminal comprising the terminal structure according to claim 13.

15. The terminal structure according to claim 7, wherein the contact target section is arranged and provided in a resin holder with a first surface of the contact target section from which the protruding section protrudes, and the protruding section being exposed.

16. A portable terminal comprising the terminal structure according to claim 15.

* * * * *